US008806779B2

(12) United States Patent
Auger et al.

(10) Patent No.: US 8,806,779 B2
(45) Date of Patent: Aug. 19, 2014

(54) SHAPED SUPPORT FEATURES FOR FOOTWEAR GROUND-ENGAGING MEMBERS

(75) Inventors: Perry W. Auger, Tigard, OR (US); Andrew Caine, Portland, OR (US); Sergio Cavaliere, Venice (IT)

(73) Assignee: NIKE, Inc., Beaverton, OR (US)

( * ) Notice: Subject to any disclaimer, the term of this patent is extended or adjusted under 35 U.S.C. 154(b) by 37 days.

(21) Appl. No.: 13/234,180

(22) Filed: Sep. 16, 2011

(65) Prior Publication Data

US 2013/0067772 A1 Mar. 21, 2013

(51) Int. Cl.
*A43C 15/00* (2006.01)

(52) U.S. Cl.
USPC ..... 36/67 A; 36/59 R; 36/128

(58) Field of Classification Search
USPC .... 36/103, 126–129, 59 A–59 C, 59 R, 67 A, 36/114
See application file for complete search history.

(56) References Cited

U.S. PATENT DOCUMENTS

| | | | |
|---|---|---|---|
| D15,185 | S | 8/1884 | Brooks |
| 830,324 | A | 9/1906 | Hunt |
| 1,087,212 | A | 2/1914 | Caldwell |
| 1,361,078 | A | 12/1920 | Lynn |
| D81,917 | S | 9/1930 | Burchfield |
| 2,087,945 | A | 7/1937 | Butler |
| 2,095,095 | A | 10/1937 | Howard |
| 2,101,693 | A | 12/1937 | Taraci |
| 2,173,968 | A | 9/1939 | King |
| 2,185,397 | A | 1/1940 | Birchfield |
| 2,195,490 | A | 4/1940 | Lyness |
| D171,130 | S | 12/1953 | Gruner |
| 3,043,026 | A | 7/1962 | Semon |
| 3,063,171 | A | 11/1962 | Hollander |
| 3,127,687 | A | 4/1964 | Hollister et al. |
| D201,865 | S | 8/1965 | Bingham, Jr. et al. |

(Continued)

FOREIGN PATENT DOCUMENTS

| | | |
|---|---|---|
| DE | 930798 | 7/1955 |
| DE | 1809860 | 4/1960 |

(Continued)

OTHER PUBLICATIONS

International Preliminary Report on Patentability (including Written Opinion of the ISA) mailed Aug. 1, 2013 in International Application No. PCT/US2012/021663.

(Continued)

*Primary Examiner* — Khoa Huynh
*Assistant Examiner* — Megan Brandon
(74) *Attorney, Agent, or Firm* — Plumsea Law Group, LLC

(57) ABSTRACT

The present disclosure is directed to an article of footwear including an upper configured to receive a foot and a sole component fixedly attached to a bottom portion of the upper. The sole component may include a baseplate having a bottom surface and at least a first ground engaging member extending substantially downward from the bottom surface of the baseplate, and a first elongate support member extending substantially downward from the bottom surface of the baseplate, abutting the first ground engaging member at a side portion, and extending horizontally from the side portion of the first ground engaging member. The first support member may have a downward facing surface with a first facet and a second facet, wherein each of the first facet and the second facet are angled at different non-horizontal orientation.

20 Claims, 18 Drawing Sheets

(56) References Cited

U.S. PATENT DOCUMENTS

| | | | |
|---|---|---|---|
| 3,328,901 | A | 7/1967 | Strickland |
| 3,341,952 | A | 9/1967 | Dassler |
| 3,352,034 | A | 11/1967 | Braun |
| D213,416 | S | 3/1969 | Dittmar et al. |
| 3,481,820 | A | 12/1969 | Jonas |
| D219,503 | S | 12/1970 | Vietas |
| 3,597,863 | A | 8/1971 | Austin et al. |
| 3,619,916 | A | 11/1971 | Neri |
| 3,631,614 | A | 1/1972 | Rice |
| 3,656,245 | A | 4/1972 | Wilson |
| 3,758,891 | A | 9/1973 | Geister |
| 3,775,874 | A | 12/1973 | Bonneville |
| 3,898,751 | A | 8/1975 | Gustin |
| 3,951,407 | A | 4/1976 | Calacurcio |
| 4,096,649 | A | 6/1978 | Saurwein |
| 4,107,858 | A | 8/1978 | Bowerman et al. |
| 4,130,947 | A | 12/1978 | Denu |
| 4,146,979 | A | 4/1979 | Fabbrie |
| 4,245,406 | A | 1/1981 | Landay et al. |
| 4,315,374 | A | 2/1982 | Sneeringer |
| 4,335,530 | A | 6/1982 | Stubblefield |
| 4,347,674 | A | 9/1982 | George |
| 4,375,728 | A | 3/1983 | Dassler |
| 4,375,729 | A | 3/1983 | Buchanen, III |
| 4,392,312 | A | 7/1983 | Crowley et al. |
| D271,159 | S | 11/1983 | Muller-Feigelstock |
| D272,200 | S | 1/1984 | Autry et al. |
| D272,772 | S | 2/1984 | Kohno |
| 4,454,662 | A | 6/1984 | Stubblefield |
| D278,759 | S | 5/1985 | Norton et al. |
| 4,546,559 | A | 10/1985 | Dassler |
| 4,574,498 | A | 3/1986 | Norton et al. |
| 4,586,274 | A | 5/1986 | Blair |
| D287,662 | S | 1/1987 | Tonkel |
| 4,633,600 | A | 1/1987 | Dassler et al. |
| 4,667,425 | A | 5/1987 | Effler et al. |
| 4,674,200 | A | 6/1987 | Sing |
| 4,689,901 | A | 9/1987 | Ihlenburg |
| 4,698,923 | A | 10/1987 | Arff |
| 4,715,133 | A | 12/1987 | Hartjes et al. |
| D294,655 | S | 3/1988 | Heyes |
| D295,231 | S | 4/1988 | Heyes |
| 4,833,796 | A | 5/1989 | Flemming |
| 4,858,343 | A | 8/1989 | Flemming |
| 4,873,774 | A | 10/1989 | Lafever |
| 4,914,838 | A | 4/1990 | Ihlenburg |
| 4,984,377 | A | 1/1991 | Schneider |
| 5,025,573 | A | 6/1991 | Giese et al. |
| D322,510 | S | 12/1991 | Miller |
| 5,077,916 | A | 1/1992 | Beneteau |
| 5,174,049 | A | 12/1992 | Flemming |
| 5,177,883 | A | 1/1993 | Darby |
| 5,201,126 | A | 4/1993 | Tanel |
| 5,221,379 | A | 6/1993 | Nicholas |
| D339,459 | S | 9/1993 | Yoshikawa et al. |
| 5,289,647 | A | 3/1994 | Mercer |
| 5,299,369 | A | 4/1994 | Goldman |
| 5,335,429 | A | 8/1994 | Hansen |
| 5,339,544 | A | 8/1994 | Caberlotto |
| 5,351,422 | A | 10/1994 | Fitzgerald |
| 5,367,791 | A | 11/1994 | Gross et al. |
| 5,384,973 | A | 1/1995 | Lyden |
| 5,406,723 | A | 4/1995 | Okajima |
| 5,410,823 | A | 5/1995 | Lyoob |
| 5,416,989 | A | 5/1995 | Preston |
| 5,435,077 | A | 7/1995 | Pyle |
| 5,452,526 | A | 9/1995 | Collins |
| 5,461,801 | A | 10/1995 | Anderton |
| 5,473,827 | A | 12/1995 | Barre et al. |
| D368,156 | S | 3/1996 | Longbottom et al. |
| D368,360 | S | 4/1996 | Wolfe |
| D369,672 | S | 5/1996 | Tanaka et al. |
| 5,513,451 | A | 5/1996 | Kataoka et al. |
| 5,526,589 | A | 6/1996 | Jordan |
| 5,555,650 | A | 9/1996 | Longbottom et al. |
| 5,572,807 | A | 11/1996 | Kelly et al. |
| 5,617,653 | A | 4/1997 | Walker et al. |
| 5,634,283 | A | 6/1997 | Kastner |
| D387,892 | S | 12/1997 | Briant |
| D389,298 | S | 1/1998 | Briant |
| 5,709,954 | A | 1/1998 | Lyden et al. |
| D394,943 | S | 6/1998 | Campbell et al. |
| 5,775,010 | A | 7/1998 | Kaneko |
| 5,806,209 | A | 9/1998 | Crowley et al. |
| 5,815,951 | A | 10/1998 | Jordan |
| 5,832,636 | A | 11/1998 | Lyden et al. |
| 5,887,371 | A | 3/1999 | Curley, Jr. |
| 5,946,828 | A | 9/1999 | Jordan et al. |
| 5,956,871 | A | 9/1999 | Korsen |
| D415,340 | S | 10/1999 | McMullin |
| 5,979,083 | A | 11/1999 | Robinson et al. |
| 5,983,529 | A | 11/1999 | Serna |
| 5,987,783 | A | 11/1999 | Allen et al. |
| 6,016,613 | A | 1/2000 | Campbell et al. |
| D421,833 | S | 3/2000 | Fallon |
| 6,035,559 | A | 3/2000 | Freed et al. |
| 6,079,127 | A | 6/2000 | Nishimura et al. |
| D427,754 | S | 7/2000 | Portaud |
| 6,101,746 | A | 8/2000 | Evans |
| 6,112,433 | A | 9/2000 | Greiner |
| 6,125,556 | A | 10/2000 | Peckler et al. |
| 6,145,221 | A | 11/2000 | Hockerson |
| 6,161,315 | A | 12/2000 | Dalton |
| D437,108 | S | 2/2001 | Peabody |
| D437,989 | S | 2/2001 | Cass |
| 6,199,303 | B1 | 3/2001 | Luthi et al. |
| 6,231,946 | B1 | 5/2001 | Brown, Jr. et al. |
| 6,256,907 | B1 | 7/2001 | Jordan et al. |
| 6,357,146 | B1 | 3/2002 | Wordsworth et al. |
| 6,389,714 | B1 | 5/2002 | Mack |
| D461,297 | S | 8/2002 | Lancon |
| 6,481,122 | B2 | 11/2002 | Brahler |
| D468,517 | S | 1/2003 | Recchi et al. |
| 6,550,160 | B2 | 4/2003 | Miller, II |
| 6,557,270 | B2 | 5/2003 | Nakano et al. |
| D477,905 | S | 8/2003 | Adams et al. |
| D478,714 | S | 8/2003 | Recchi |
| 6,647,647 | B2 | 11/2003 | Auger et al. |
| 6,675,505 | B2 | 1/2004 | Terashima |
| 6,698,110 | B1 | 3/2004 | Robbins |
| 6,708,427 | B2 | 3/2004 | Sussmann et al. |
| 6,725,574 | B2 | 4/2004 | Hokkirigawa et al. |
| 6,739,075 | B2 | 5/2004 | Sizemore |
| 6,754,984 | B2 | 6/2004 | Schaudt et al. |
| D495,122 | S | 8/2004 | McMullin |
| 6,834,446 | B2 | 12/2004 | McMullin |
| 6,892,479 | B2 | 5/2005 | Auger et al. |
| 6,904,707 | B2 | 6/2005 | McMullin |
| 6,915,595 | B2 | 7/2005 | Kastner |
| 6,915,596 | B2 | 7/2005 | Grove et al. |
| 6,935,055 | B2 | 8/2005 | Oorei |
| 6,941,684 | B2 | 9/2005 | Auger et al. |
| 6,954,998 | B1 | 10/2005 | Lussier |
| 6,968,637 | B1 | 11/2005 | Johnson |
| 6,973,745 | B2 | 12/2005 | Mills et al. |
| 6,973,746 | B2 | 12/2005 | Auger et al. |
| 7,007,410 | B2 | 3/2006 | Auger et al. |
| D525,416 | S | 7/2006 | Auger et al. |
| 7,143,530 | B2 | 12/2006 | Hudson et al. |
| 7,181,868 | B2 | 2/2007 | Auger et al. |
| 7,194,826 | B2 | 3/2007 | Ungari |
| 7,234,250 | B2 | 6/2007 | Fogarty et al. |
| 7,254,909 | B2 | 8/2007 | Ungari |
| 7,269,916 | B2 | 9/2007 | Biancucci et al. |
| D553,336 | S | 10/2007 | McMullin |
| 7,287,343 | B2 | 10/2007 | Healy |
| 7,370,439 | B1 | 5/2008 | Myers |
| D571,092 | S | 6/2008 | Norton |
| D571,542 | S | 6/2008 | Wilken |
| 7,386,948 | B2 | 6/2008 | Sink |
| D573,779 | S | 7/2008 | Stauffer |
| 7,401,418 | B2 | 7/2008 | Wyszynski et al. |
| D575,041 | S | 8/2008 | Wilken |
| 7,406,781 | B2 | 8/2008 | Scholz |

(56) References Cited

U.S. PATENT DOCUMENTS

| | | | |
|---|---|---|---|
| 7,409,783 | B2 | 8/2008 | Chang |
| D578,280 | S | 10/2008 | Wilken |
| 7,430,819 | B2 | 10/2008 | Auger et al. |
| 7,441,350 | B2 | 10/2008 | Auger et al. |
| 7,490,418 | B2 | 2/2009 | Obeydani |
| 7,536,810 | B2 | 5/2009 | Jau et al. |
| 7,549,236 | B2 | 6/2009 | Dillon et al. |
| 7,559,160 | B2 | 7/2009 | Kelly |
| 7,584,554 | B2 | 9/2009 | Fogarty et al. |
| 7,610,695 | B2 | 11/2009 | Hay |
| 7,650,707 | B2 | 1/2010 | Campbell et al. |
| 7,654,013 | B2 | 2/2010 | Savoie et al. |
| 7,665,229 | B2 | 2/2010 | Kilgore et al. |
| 7,673,400 | B2 | 3/2010 | Brown et al. |
| 7,685,741 | B2 | 3/2010 | Friedman |
| 7,685,745 | B2 | 3/2010 | Kuhtz et al. |
| 7,707,748 | B2 | 5/2010 | Campbell |
| 7,762,009 | B2 | 7/2010 | Gerber |
| 7,784,196 | B1 | 8/2010 | Christensen et al. |
| 7,866,064 | B2 | 1/2011 | Gerber |
| D632,466 | S | 2/2011 | Kasprzak |
| D635,338 | S | 4/2011 | Favreau et al. |
| 8,079,160 | B2 | 12/2011 | Baucom et al. |
| 8,122,617 | B1 | 2/2012 | Dixon et al. |
| 8,256,145 | B2 | 9/2012 | Baucom et al. |
| 2002/0017036 | A1 | 2/2002 | Berger et al. |
| 2002/0062578 | A1 | 5/2002 | Lussier et al. |
| 2002/0069559 | A1 | 6/2002 | Gee |
| 2002/0078603 | A1 | 6/2002 | Schmitt, Jr. |
| 2002/0100190 | A1 | 8/2002 | Pellerin |
| 2002/0144429 | A1 | 10/2002 | Hay |
| 2002/0178619 | A1 | 12/2002 | Schaudt et al. |
| 2003/0019127 | A1 | 1/2003 | Parisotto |
| 2003/0029060 | A1 | 2/2003 | Hockerson et al. |
| 2003/0033731 | A1 | 2/2003 | Sizemore |
| 2003/0188458 | A1 | 10/2003 | Kelly |
| 2003/0200675 | A1 | 10/2003 | Gross |
| 2004/0000075 | A1 | 1/2004 | Auger et al. |
| 2004/0035024 | A1 | 2/2004 | Kao |
| 2004/0187356 | A1 | 9/2004 | Patton |
| 2004/0250451 | A1 | 12/2004 | McMullin |
| 2005/0016029 | A1 | 1/2005 | Auger et al. |
| 2005/0072026 | A1 | 4/2005 | Sink |
| 2005/0097783 | A1 | 5/2005 | Mills et al. |
| 2005/0108898 | A1 | 5/2005 | Jeppesen et al. |
| 2005/0120593 | A1 | 6/2005 | Mason |
| 2005/0217149 | A1 | 10/2005 | Ho |
| 2005/0257405 | A1 | 11/2005 | Kilgore |
| 2005/0268490 | A1 | 12/2005 | Foxen |
| 2006/0016101 | A1 | 1/2006 | Ungari |
| 2006/0021254 | A1 | 2/2006 | Jones |
| 2006/0021255 | A1 | 2/2006 | Auger et al. |
| 2006/0021259 | A1 | 2/2006 | Wood et al. |
| 2006/0042124 | A1 | 3/2006 | Mills et al. |
| 2006/0064905 | A1 | 3/2006 | Hudson et al. |
| 2006/0090373 | A1 | 5/2006 | Savoie et al. |
| 2006/0130372 | A1 | 6/2006 | Auger et al. |
| 2006/0242863 | A1 | 11/2006 | Patmore |
| 2007/0039209 | A1 | 2/2007 | White et al. |
| 2007/0124960 | A1 | 6/2007 | Friedman |
| 2007/0199211 | A1 | 8/2007 | Campbell |
| 2007/0199213 | A1 | 8/2007 | Campbell et al. |
| 2007/0209230 | A1 | 9/2007 | Dillon et al. |
| 2007/0261271 | A1 | 11/2007 | Krouse |
| 2007/0266597 | A1 | 11/2007 | Jones |
| 2008/0010863 | A1 | 1/2008 | Auger et al. |
| 2008/0066348 | A1 | 3/2008 | O'Brien et al. |
| 2008/0098624 | A1 | 5/2008 | Goldman |
| 2008/0196276 | A1 | 8/2008 | McMullin |
| 2008/0216352 | A1 | 9/2008 | Baucom et al. |
| 2008/0282579 | A1 | 11/2008 | Bobbett et al. |
| 2009/0019732 | A1 | 1/2009 | Sussmann |
| 2009/0056169 | A1 | 3/2009 | Robinson, Jr. et al. |
| 2009/0056172 | A1 | 3/2009 | Cho |
| 2009/0100716 | A1 | 4/2009 | Gerber |
| 2009/0100718 | A1 | 4/2009 | Gerber |
| 2009/0113758 | A1 | 5/2009 | Nishiwaki et al. |
| 2009/0113765 | A1 | 5/2009 | Robinson, Jr. et al. |
| 2009/0126230 | A1 | 5/2009 | McDonald et al. |
| 2009/0211118 | A1 | 8/2009 | Krikorian et al. |
| 2009/0223088 | A1 | 9/2009 | Krikorian et al. |
| 2009/0235558 | A1* | 9/2009 | Auger et al. ..... 36/30 R |
| 2009/0241370 | A1 | 10/2009 | Kimura |
| 2009/0241377 | A1 | 10/2009 | Kita et al. |
| 2009/0272008 | A1 | 11/2009 | Nomi et al. |
| 2009/0293315 | A1* | 12/2009 | Auger et al. ..... 36/114 |
| 2009/0307933 | A1 | 12/2009 | Leach |
| 2010/0050471 | A1 | 3/2010 | Kim |
| 2010/0077635 | A1 | 4/2010 | Baucom et al. |
| 2010/0083541 | A1 | 4/2010 | Baucom et al. |
| 2010/0107450 | A1 | 5/2010 | Locke et al. |
| 2010/0126044 | A1 | 5/2010 | Davis |
| 2010/0199523 | A1 | 8/2010 | Mayden et al. |
| 2010/0212190 | A1 | 8/2010 | Schmid |
| 2010/0229427 | A1 | 9/2010 | Campbell et al. |
| 2010/0251578 | A1 | 10/2010 | Auger et al. |
| 2010/0313447 | A1 | 12/2010 | Becker et al. |
| 2011/0047830 | A1 | 3/2011 | Francello et al. |
| 2011/0078922 | A1 | 4/2011 | Cavaliere et al. |
| 2011/0078927 | A1 | 4/2011 | Baker |
| 2011/0088287 | A1 | 4/2011 | Auger et al. |
| 2011/0126426 | A1 | 6/2011 | Amark |
| 2011/0167676 | A1 | 7/2011 | Benz et al. |
| 2011/0197475 | A1 | 8/2011 | Weidl et al. |
| 2011/0197478 | A1 | 8/2011 | Baker |
| 2011/0203136 | A1 | 8/2011 | Auger et al. |
| 2012/0180343 | A1 | 7/2012 | Auger et al. |
| 2013/0067765 | A1 | 3/2013 | Auger et al. |
| 2013/0067773 | A1 | 3/2013 | Auger et al. |
| 2013/0067774 | A1 | 3/2013 | Auger et al. |
| 2013/0067776 | A1 | 3/2013 | Auger et al. |

FOREIGN PATENT DOCUMENTS

| | | |
|---|---|---|
| DE | 3046811 | 7/1982 |
| DE | 3135347 | 3/1983 |
| DE | 3245182 | 5/1983 |
| DE | 3600525 | 10/1987 |
| DE | 3644812 | 6/1988 |
| DE | 3706069 | 9/1988 |
| DE | 4417563 | 11/1995 |
| DE | 19817579 | 10/1999 |
| EP | 115663 | 8/1984 |
| EP | 123550 | 10/1984 |
| EP | 0223700 | 5/1987 |
| EP | 340053 | 11/1989 |
| EP | 0723745 | 7/1996 |
| EP | 1025771 | 8/2000 |
| EP | 1714571 | 10/2006 |
| EP | 1839511 | 10/2007 |
| EP | 2057913 | 5/2009 |
| EP | 2499928 | 9/2012 |
| FR | 1554061 | 1/1969 |
| FR | 2567004 | 1/1986 |
| FR | 2818876 | 7/2002 |
| GB | 1329314 | 9/1973 |
| GB | 2020161 | 11/1979 |
| GB | 2113971 | 8/1983 |
| GB | 2256784 | 12/1992 |
| GB | 2377616 | 1/2003 |
| GB | 2425706 | 11/2006 |
| JP | 10000105 | 1/1998 |
| JP | 10066605 | 3/1998 |
| JP | 11276204 | 10/1999 |
| JP | 2002272506 | 9/2002 |
| JP | 2002306207 | 10/2002 |
| JP | 2004024811 | 1/2004 |
| JP | 2005185303 | 7/2005 |
| JP | 2005304653 | 11/2005 |
| TW | 540323 | 7/2003 |
| TW | M267886 | 6/2005 |
| WO | 0053047 | 9/2000 |
| WO | 03045182 | 6/2003 |
| WO | 03071893 | 9/2003 |

(56) References Cited

FOREIGN PATENT DOCUMENTS

| | | |
|---|---|---|
| WO | 2006103619 | 10/2006 |
| WO | 2008069751 | 6/2008 |
| WO | 2008128712 | 10/2008 |
| WO | 2009110822 | 9/2009 |
| WO | 2010036988 | 4/2010 |
| WO | 2010057207 | 5/2010 |
| WO | 2012150971 | 11/2012 |
| WO | 2013039701 | 3/2013 |
| WO | 2013039702 | 3/2013 |
| WO | 2013039703 | 3/2013 |
| WO | 2013039704 | 3/2013 |
| WO | 2013058874 | 4/2013 |

OTHER PUBLICATIONS

Restriction Requirement mailed Jul. 17, 2013 in U.S. Appl. No. 13/234,182.
Response to Restriction Requirement filed Aug. 15, 2013 in U.S. Appl. No. 13/234,182.
Restriction Requirement mailed Aug. 1, 2013 in U.S. Appl. No. 13/234,185.
Restriction Requirement mailed Aug. 12, 2013 in U.S. Appl. No. 13/234,244.
Restriction Requirement mailed Jul. 10, 2013 in U.S. Appl. No. 13/009,549.
Response to Restriction Requirement filed Aug. 8, 2013 in U.S. Appl. No. 13/009,549.
Response to Restriction Requirement filed Aug. 29, 2013 in U.S. Appl. No. 13/234,185.
Response to Restriction Requirement filed Aug. 29, 2013 in U.S. Appl. No. 13/234,244.
Response to Office Action filed Sep. 12, 2012 in U.S. Appl. No. 12/582,252.
Notice of Allowance mailed Sep. 20, 2012 in U.S. Appl. No. 12/582,252.
International Search Report and Written Opinion for PCT/US2011/045356 dated Dec. 16, 2011.
International Search Report and Written Opinion for PCT/US2011/022841 dated Apr. 15, 2011.
International Search Report and Written Opinion for PCT/US2011/022848 dated Jun. 20, 2011.
Aug. 12, 2010, Icebug Web Page (date based on information from Internet Archive).
Dec. 23, 2008, Icebug Web Page (date based on information from Internet Archive).
International Search Report for PCT/US2010/050637 dated Jan. 14, 2011.
Partial Search Report for PCT/US2009/058522 dated Mar. 4, 2010.
U.S. Appl. No. 12/239,190, filed Sep. 26, 2008.
U.S. Appl. No. 12/566,792, filed Sep. 25, 2009.
U.S. Appl. No. 12/711,107, filed Feb. 23, 2010.
U.S. Appl. No. 12/708,411, filed Feb. 18, 2010.
U.S. Appl. No. 12/572,154, filed Oct. 1, 2009.
International Search Report for PCT/US2009/058522 dated Feb. 17, 2010.
International Search Report for PCT/US2010/029640 dated May 17, 2010.
Pending U.S. Appl. No. 13/561,608, filed Jul. 30, 2012.
Pending U.S. Appl. No. 13/561,557, filed Jul. 30, 2012.
Invitation to Pay Additional Fees and, Where Applicable, Protest Fee mailed Jan. 7, 2013 in International Application No. PCT/US2012/052968.
Invitation to Pay Additional Fees and, Where Applicable, Protest Fee mailed Jan. 8, 2013 in International Application No. PCT/US2012/052970.
Invitation to Pay Additional Fees and, Where Applicable, Protest Fee mailed Jan. 7, 2013 in International Application No. PCT/US2012/052965.
International Search Report and Written Opinion mailed Jan. 22, 2013 in International Application No. PCT/US2012/052972.
Invitation to Pay Additional Fees and, Where Applicable, Protest Fee mailed Feb. 8, 2013 in International Application No. PCT/US2012/052963.
International Search Report and Written Opinion mailed Mar. 8, 2013 in International Application No. PCT/US2012/052965.
International Search Report and Written Opinion mailed Mar. 8, 2013 in International Application No. PCT/US2012/052968.
International Search Report and Written Opinion mailed Mar. 8, 2013 in International Application No. PCT/US2012/052970.
International Search Report and Written Opinion mailed Jul. 4, 2013, in International Patent Application PCT/US2012/052963.
International Search Report and Written Opinion mailed Jun. 13, 2012 in International Application No. PCT/US2012/021663.
Office Action mailed Jun. 13, 2012 in U.S. Appl. No. 12/582,252.
Pending U.S. Appl. No. 13/705,600, filed Dec. 5, 2012.
Pending U.S. Appl. No. 13/705,622, filed Dec. 5, 2012.
Office Action mailed Sep. 23, 2013 in U.S. Appl. No. 13/234,182.
Office Action mailed Sep. 26, 2013 in U.S. Appl. No. 13/234,185.
Office Action mailed Sep. 4, 2013 in U.S. Appl. No. 13/009,549.
Response to Office Action filed Dec. 23, 2013 in U.S. Appl. No. 13/234,182.
Response to Office Action filed Dec. 26, 2013 in U.S. Appl. No. 13/234,185.
Response to Office Action filed Dec. 4, 2013 in U.S. Appl. No. 13/009,549.
Final Office Action mailed Feb. 4, 2014 in U.S. Appl. No. 13/234,182.
Final Office Action mailed Mar. 6, 2014 in U.S. Appl. No. 13/234,185.
Notice of Allowance mailed Dec. 20, 2013 in U.S. Appl. No. 13/009,549.
312 Amendment filed Feb. 25, 2014 in U.S. Appl. No. 13/009,549.
Response to PCT Written Opinion filed Mar. 10, 2014 in European Patent Application No. 12 709 407.6.
International Preliminary Report on Patentability mailed Mar. 27, 2014 in PCT/US2012/052968.
International Preliminary Report on Patentability mailed Mar. 27, 2014 in PCT/US2012/052970.
International Preliminary Report on Patentability mailed Mar. 27, 2014 in PCT/US2012/052972.
International Preliminary Report on Patentability mailed Mar. 27, 2014 in PCT/US2012/052965.
Voluntary Amendments filed Apr. 15, 2014 in EP 12778481.7.
Voluntary Amendments filed Apr. 15, 2014 in EP 12778482.5.
Voluntary Amendments filed Apr. 15, 2014 in EP 12778483.3.
Voluntary Amendments filed Apr. 15, 2014 in EP 12778484.1.
Office Action Restriction Requirement mailed Apr. 1, 2014 in U.S. Appl. No. 13/234,183.
Response to Office Action filed May 5, 2014 in U.S. Appl. No. 13/234,182.
Response to Restriction Requirement filed May 20, 2014 in U.S. Appl. No. 13/234,183.
Response to Office Action filed May 30, 2014 in U.S. Appl. No. 13/234,185.
Office Action mailed Jun. 4, 2014 in U.S. Appl. No. 13/234,182.
Pending U.S. Appl. No. 13/234,182, filed Sep. 16, 2011.
Pending U.S. Appl. No. 13/234,183, filed Sep. 16, 2011.
Pending U.S. Appl. No. 13/234,185, filed Sep. 16, 2011.
Pending U.S. Appl. No. 13/009,549, filed Jan. 19, 2011.
Pending U.S. Appl. No. 13/234,244, filed Sep. 16, 2011.
Pending U.S. Appl. No. 12/582,252, filed Oct. 20, 2009.
Pending U.S. Appl. No. 13/234,233, filed Sep. 16, 2011.
Office Action mailed Jun. 25, 2014 in U.S. Appl. No. 13/234,183.

* cited by examiner

| DIMENSION | RANGE | Example |
|---|---|---|
| H1 | ~1-20 mm | ~6 mm |
| L1 | ~1-50 mm | ~5 mm |
| $\alpha 1$ | ~1-89 deg. | ~50 degrees |
| | | |
| H2 | ~1-20 mm | ~6 mm |
| L2 | ~1-50 mm | ~18 mm |
| $\alpha 2$ | ~1-89 deg. | ~18.4 degrees |
| | | |
| H3 | ~1-20 mm | ~6 mm |
| L3 | ~1-50 mm | ~11 mm |
| $\alpha 3$ | ~1-89 deg. | ~28.6 degrees |

*FIG. 6B*

SHAPED SUPPORT FEATURES FOR FOOTWEAR GROUND-ENGAGING MEMBERS

FIELD OF THE INVENTION

The present invention relates generally to support features for ground engaging members of articles of footwear and, more particularly, ground engaging members having abutting support members with shaped configurations.

BACKGROUND

It is advantageous, when participating in various activities, to have footwear that provides traction and stability on the surface upon which the activities take place. Accordingly, sole structures for articles of footwear have been developed with traction systems that include ground engaging members to provide traction on a variety of surfaces. Examples include cleated shoes developed for outdoor sports, such as soccer, football, and baseball.

The present disclosure is directed to improvements in existing sole structure traction systems.

SUMMARY

In one aspect, the present disclosure is directed to an article of footwear including an upper configured to receive a foot and a sole component fixedly attached to a bottom portion of the upper. The sole component may include a baseplate having a bottom surface and at least a first ground engaging member extending substantially downward from the bottom surface of the baseplate. The sole component may also include a plurality of elongate support members extending substantially downward from the bottom surface of the baseplate, abutting the first ground engaging member at a side portion, and extending horizontally from the side portion of the first ground engaging member. Further, the sole component may include a textured traction surface disposed between at least two of the plurality of support members.

In another aspect, the present disclosure is directed to an article of footwear including an upper configured to receive a foot and a sole component fixedly attached to a bottom portion of the upper. The sole component may include a baseplate having a bottom surface, and at least a first ground engaging member extending substantially downward from a bottom surface of the baseplate and a second ground engaging member extending substantially downward from the bottom surface of the baseplate. The sole component may also include a first elongate support member extending substantially downward from the bottom surface of the baseplate, abutting the first and second ground engaging members at side portions, and extending horizontally between the first and second ground engaging members, wherein the first support member has a downward facing surface with three facets. A first facet may be angled upward and away from the first ground engaging member in a direction of the second ground engaging member, a second facet may be angled upward and away from the second ground engaging member in a direction of the first ground engaging member, and a third facet may be disposed between the first facet and the third facet and is substantially horizontal.

In another aspect, the present disclosure is directed to an article of footwear including an upper configured to receive a foot and a sole component fixedly attached to a bottom portion of the upper. The sole component may include a baseplate having a bottom surface and at least a first ground engaging member extending substantially downward from the bottom surface of the baseplate. The sole component may also include a plurality of elongate support members extending substantially downward from the bottom surface of the baseplate, abutting the first ground engaging member at a side portion, and extending horizontally from the side portion of the first ground engaging member; wherein three or more support members of the plurality of support members are unevenly spaced about the ground engaging member. The spaces between the three or more unevenly spaced support members may be devoid of additional support members, and the three or more support members may be independent of other ground engaging members extending from the baseplate.

In another aspect, the present disclosure is directed to an article of footwear including an upper configured to receive a foot and a sole component fixedly attached to a bottom portion of the upper. The sole component may include a baseplate having a bottom surface and at least a first ground engaging member extending substantially downward from the bottom surface of the baseplate, and a first elongate support member extending substantially downward from the bottom surface of the baseplate, abutting the first ground engaging member at a side portion, and extending horizontally from the side portion of the first ground engaging member. The first support member may have a downward facing surface with a first facet and a second facet, wherein each of the first facet and the second facet are angled at different non-horizontal orientation.

In another aspect, the present disclosure is directed to an article of footwear including an upper configured to receive a foot and a sole component fixedly attached to a bottom portion of the upper. The sole component may include a baseplate having a bottom surface and at least a first ground engaging member extending substantially downward from the bottom surface of the baseplate and a plurality of elongate support members extending substantially downward from the bottom surface of the baseplate, abutting the first ground engaging member at a side portion, and extending horizontally from the side portion of the first ground engaging member. At least two of the plurality of support members may be disposed on opposite sides of the first ground engaging member and are substantially parallel with one another, but not aligned with one another.

In another aspect, the present disclosure is directed to an article of footwear including an upper configured to receive a foot and a sole component fixedly attached to a bottom portion of the upper. The sole component may include a baseplate having a bottom surface and at least a first ground engaging member extending substantially downward from the bottom surface of the baseplate and a first elongate support member extending substantially downward from the bottom surface of the baseplate, abutting the first ground engaging member at a side portion, and extending horizontally from the side portion of the first ground engaging member. The first support member may extend horizontally away from the first ground engaging member in a direction toward a region of the sole component adjacent to a gap in the sole component.

In another aspect, the present disclosure is directed to an article of footwear including an upper configured to receive a foot and a sole component fixedly attached to a bottom portion of the upper. The sole component may include a baseplate having a bottom surface and at least a first ground engaging member extending substantially downward from the bottom surface of the baseplate and a plurality of elongate support members extending substantially downward from the bottom surface of the baseplate, abutting the first ground engaging member at a side portion, and extending horizontally from the side portion of the first ground engaging member. The first ground engaging member may be substantially elongate along a ground engaging member axis oriented in a horizontal direction. Further, at least a first support member of the plurality of support members may be substantially aligned with the ground engaging member axis, and at least a second support member of the plurality of support members may be oriented in non-alignment with the ground engaging member axis. In addition, the first and second support members may both be independent of other ground engaging members extending from the baseplate.

In another aspect, the present disclosure is directed to an article of footwear including an upper configured to receive a foot and a sole component fixedly attached to a bottom portion of the upper. The sole component may include a baseplate having a bottom surface and at least a first ground engaging member extending substantially downward from the bottom surface of the baseplate and a plurality of elongate support members extending substantially downward from the bottom surface of the baseplate, abutting the first ground engaging member at a side portion, and extending horizontally from the side portion of the first ground engaging member. At least a first support member of the plurality of support members may extend substantially radially from a center of the first ground engaging member, and at least a second support member of the plurality of support members extends horizontally from the first ground engaging member in a substantially non-radial direction with respect to the center of the first ground engaging member.

In another aspect, the present disclosure is directed to an article of footwear including an upper configured to receive a foot and a sole component fixedly attached to a bottom portion of the upper. The sole component may include a baseplate having a bottom surface and a plurality of ground engaging members including at least a first ground engaging member extending substantially downward from the bottom surface of the baseplate and a plurality of elongate support members extending substantially downward from the bottom surface of the baseplate, abutting the first ground engaging member at a side portion, and extending horizontally from the first ground engaging member. Each of the plurality of support members may extend horizontally away from the first ground engaging member in a direction that is not aligned with any other ground engaging members.

In another aspect, the present disclosure is directed to an article of footwear including an upper configured to receive a foot and a sole component fixedly attached to a bottom portion of the upper. The sole component may include a baseplate having a bottom surface and an arrangement of a plurality of ground engaging members including at least first and second forward ground engaging members extending substantially downward from the bottom surface of the baseplate and first and second rearward ground engaging members extending substantially downward from a bottom surface of the baseplate. The plurality of ground engaging members may also include first and second elongate rearward support members extending substantially downward from the bottom surface of the baseplate, respectively abutting the first and second rearward ground engaging members at side portions, and extending horizontally along orientation paths from the first and second rearward ground engaging members. The orientation paths of the first and second rearward support members may intersect at a point that is rearward of a line connecting the first and second forward ground engaging members.

In another aspect, the present disclosure is directed to an article of footwear including an upper configured to receive a foot and a sole component fixedly attached to a bottom portion of the upper. The sole component may include a baseplate having a bottom surface and an arrangement of a plurality of ground engaging members including at least first and second forward ground engaging members extending substantially downward from the bottom surface of the baseplate and first and second rearward ground engaging members extending substantially downward from the bottom surface of the baseplate. The plurality of ground engaging members may also include first and second elongate forward support members extending substantially downward from the bottom surface of the baseplate, respectively abutting the first and second forward ground engaging members at side portions, and extending horizontally along orientation paths from the first and second forward ground engaging members. The orientation paths of the first and second forward support members may intersect at a point that is forward of a line connecting the first and second rearward ground engaging members.

In another aspect, the present disclosure is directed to an article of footwear including an upper configured to receive a foot and a sole component fixedly attached to a bottom portion of the upper. The sole component may include a baseplate having a bottom surface and at least a first ground engaging member extending substantially downward from the bottom surface of the baseplate and having a hole passing substantially horizontally through the first ground engaging member. The sole component may also include a first support member extending substantially downward from the bottom surface of the baseplate, abutting the first ground engaging member at a side portion in substantial alignment with the hole, and extending horizontally from the side portion of the first ground engaging member.

In another aspect, the present disclosure is directed to an article of footwear including an upper configured to receive a foot and a sole component fixedly attached to a bottom portion of the upper. The sole component may include a baseplate having a bottom surface, at least a first ground engaging member extending substantially downward from the bottom surface of the baseplate, and a first elongate support member extending substantially downward from the bottom surface of the baseplate, abutting the first ground engaging member at a side portion, and extending horizontally from the side portion of the first ground engaging member. The first ground engaging member may be substantially elongate in a horizontal direction having a first curvature along a ground engaging member axis. The first elongate support member may extend horizontally from the first ground engaging member in a direction having a second curvature. Further, the first elongate support member may be substantially aligned with the ground engaging member axis, and the first curvature and the second curvature may be reversed.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 6B is a table listing exemplary dimensions for elongate support members;

DETAILED DESCRIPTION

Figure 1:
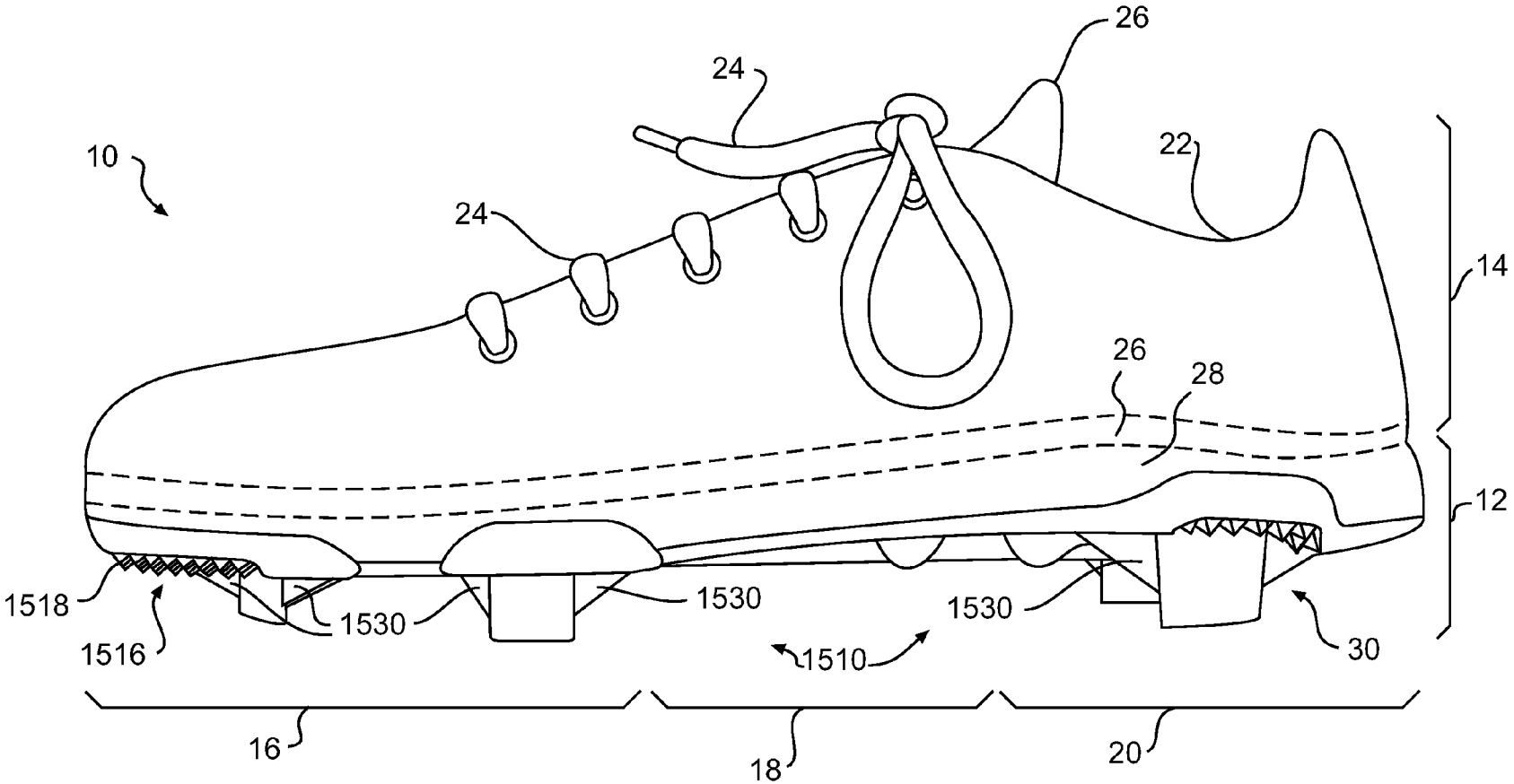
FIG. 1 is a schematic illustration of an exemplary article of footwear having a ground engaging sole component with ground engaging members.

The following discussion and accompanying figures disclose a sole structure for an article of footwear. Concepts associated with the footwear disclosed herein may be applied to a variety of athletic footwear types, including soccer shoes, baseball shoes, football shoes, golf shoes, and hiking shoes and boots, for example. Accordingly, the concepts disclosed herein apply to a wide variety of footwear types.

For consistency and convenience, directional adjectives are employed throughout this detailed description corresponding to the illustrated embodiments. The term "longitudinal," as used throughout this detailed description and in the claims, refers to a direction extending a length of a sole structure, i.e., extending from a forefoot portion to a heel portion of the sole. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a sole. In other words, the lateral direction may extend between a medial side and a lateral side of an article of footwear, with the lateral side of the article of footwear being the surface that faces away from the other foot, and the medial side being the surface that faces toward the other foot.

The term "horizontal," as used throughout this detailed description and in the claims, refers to any direction substantially parallel with the ground, including the longitudinal direction, the lateral direction, and all directions in between. Similarly, the term "side," as used in this specification and in the claims, refers to any portion of a component facing generally in a lateral, medial, forward, and/or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, and/or other joining techniques. In addition, two components may be "fixedly attached" by virtue of being integrally formed, for example, in a molding process.

Footwear Structure

FIG. 1 depicts an embodiment of an article of footwear 10, which may include a sole structure 12 and an upper 14. For reference purposes, footwear 10 may be divided into three general regions: a forefoot region 16, a midfoot region 18, and a heel region 20. Forefoot region 16 generally includes portions of footwear 10 corresponding with the toes and the joints connecting the metatarsals with the phalanges. Midfoot region 18 generally includes portions of footwear 10 corresponding with an arch area of the foot. Heel region 20 generally corresponds with rear portions of the foot, including the calcaneus bone. Regions 16, 18, and 20 are not intended to demarcate precise areas of footwear 10. Rather, regions 16, 18, and 20 are intended to represent general relative areas of footwear 10 to aid in the following discussion.

Since sole structure 12 and upper 14 both span substantially the entire length of footwear 10, the terms forefoot region 16, midfoot region 18, and heel region 20 apply not only to footwear 10 in general, but also to sole structure 12 and upper 14, as well as the individual elements of sole structure 12 and upper 14.

As shown in FIG. 1, upper 14 may include one or more material elements (for example, textiles, foam, leather, and synthetic leather), which may be stitched, adhesively bonded, molded, or otherwise formed to define an interior void configured to receive a foot. The material elements may be selected and arranged to selectively impart properties such as durability, air-permeability, wear-resistance, flexibility, and comfort. An ankle opening 22 in heel region 20 provides access to the interior void. In addition, upper 14 may include a lace 24, which may be utilized to modify the dimensions of the interior void, thereby securing the foot within the interior void and facilitating entry and removal of the foot from the interior void. Lace 24 may extend through apertures in upper 20, and a tongue portion 26 of upper 14 may extend between the interior void and lace 24. Upper 14 may alternatively implement any of a variety of other configurations, materials, and/or closure mechanisms. For example, upper 14 may include sock-like liners instead of a more traditional tongue; alternative closure mechanisms, such as hook and loop fasteners (for example, straps), buckles, clasps, cinches, or any other arrangement for securing a foot within the void defined by upper 14.

Sole structure 12 may be fixedly attached to upper 14 (for example, with adhesive, stitching, welding, and/or other suitable techniques) and may have a configuration that extends between upper 14 and the ground. Sole structure 12 may include provisions for attenuating ground reaction forces (that is, cushioning the foot). In addition, sole structure 12 may be configured to provide traction, impart stability, and/or limit various foot motions, such as pronation, supination, and/or other motions.

The configuration of sole structure 12 may vary significantly according to one or more types of ground surfaces on which sole structure 12 may be used, for example, natural turf (e.g., grass), synthetic turf, dirt, snow, synthetic rubber surfaces (e.g., running tracks) and other indoor surfaces. In addition, the configuration of sole structure 12 may vary significantly according to the type of activity for which footwear 10 is anticipated to be used (for example, running, hiking, soccer, baseball, football, and other activities).

Sole structure 12 may also vary based on the properties and conditions of the surfaces on which footwear 10 is anticipated to be used. For example, sole structure 12 may vary depending on whether the surface is harder or softer. In addition, sole structure 12 may be tailored for use in wet or dry conditions.

In some embodiments, sole structure 12 may be configured for a particularly specialized surface and/or condition. For example, in some embodiments, sole structure 12 may include a sole for a soccer shoe configured to provide traction and stability on soft, natural turf surfaces in wet conditions. In some such embodiments, sole structure 12 may include, for example, a low number of ground engaging members, wherein the ground engaging members are aggressively shaped, and having a relatively large size. Conversely, an alternative embodiment of sole structure 12 may be configured to provide traction and stability on hard, artificial turf surfaces in dry conditions. In some such embodiments, sole structure 12 may include, for example, a larger number of ground engaging members, which may be relatively smaller in size, and may have less aggressive shapes. While the number, size, and shape of ground engaging members are provided for exemplary purposes, other structural parameters may be varied in order to tailor the shoe for traction and stability on various surfaces, and/or in a variety of conditions. Additional such parameters may include, for example, the use of secondary traction elements, placement of ground engaging members, the relative softness or hardness of the ground engaging members and/or sole structure 12 in general, the relative flexibility of portions of sole structure 12, and other such parameters.

In some embodiments, sole structure 12 may be configured for versatility. For example, sole structure 12 may be configured to provide traction and stability on a variety of surfaces, having a range of properties, and/or under various conditions. For example, a versatile embodiment of sole structure 12 may include a medium number of ground engaging members, having a medium size and moderately aggressive shapes.

In addition to surface properties and conditions, sole structure 12 may also be configured based on the physical characteristics of the athlete anticipated to wear the footwear, and/or according to the type of activity anticipated to be performed while wearing the footwear. Football players, depending on the position they play, can have a wide range of physical characteristics and abilities. For example, linemen may be relatively heavy, relatively slower, but also much more powerful than players who play other positions. Linemen may place larger loads on a sole structure that may be sustained over longer durations, for example, up to one or two seconds, while engaging with opposing linemen.

In contrast, skilled player positions, such as wide receivers, may be relatively lighter weight, but much faster. Skilled player positions, may place more explosive and transient loads on a sole structure, via sprinting, cutting, and jumping, and thus, may also maintain those loads for only a relatively short duration (for example, a split second). Linebackers may have physical characteristics and abilities that represent a combination of the physical traits and abilities of linemen and wide receivers. While linebackers may possess speed and agility and operate in open field like a wide receiver, linebackers may also be larger, heavier, and more powerful, and also engage other players in tackling/blocking situations, like a lineman.

In view of the differing demands linemen and wide receivers may place on sole structures, sole structures most suitable for each type of player may be configured differently. For example, the sole structures of linemen shoes may be configured to be more stiff and durable, and also to distribute loads across the sole of the shoe. In contrast, wide receiver shoes may have sole structures that are configured for light weight, more selective flexibility and stiffness at different areas of the foot, fast ground penetration and egress by ground engaging members, and lateral responsiveness. Further, a sole structure configured for use by a linebacker may be more versatile, possessing compromises of strength, stiffness, stability, light weight, directional traction, and other characteristics.

Other types of activities may place similar and/or different demands on a sole structure of a shoe. For example, soccer athletes may place similar demands as wide receivers, that is, loads based on speed and agility. Thus, soul structures having light weight, responsiveness, fast ground penetration and egress, and traction in a variety of directions and at a variety of ground contact angles may be advantageous. In other sports, the demands may be more focused. For example, sole structures configured for use by track and field sprinters, who only run in a straight line at high speeds and accelerations, may be configured for light weight, straight line traction, and fast surface penetration and egress. In contrast, a sole structure configured for hiking may be configured quite differently. For example, a hiking sole structure may be configured to provide stability over uneven surfaces, protection from harsh surfaces (such as sharp rocks), traction on uphill and downhill slopes, and grip on a variety of surfaces, for example, natural turf, dirt, rocks, wood, snow, ice, and other natural surfaces that may be traversed by a hiker.

The accompanying figures depict various embodiments of cleated shoes, having sole structures suited for natural and/or synthetic turf. Although footwear 10, as depicted, may be suited for soccer, such a cleated shoe may be applicable for use in other activities on natural and/or synthetic turf, such as baseball, football, and other such activities where traction and grip may be significantly enhanced by cleat members. In addition, various features of the disclosed sole structures (and/or variations of such features) may be implemented in a variety of other types of footwear.

In some embodiments, sole structure 12 may include multiple components, which may individually and/or collectively provide footwear 10 with a number of attributes, such as support, rigidity, flexibility, stability, cushioning, comfort, reduced weight, and/or other attributes. In some embodiments, sole structure 12 may include an insole 26, a midsole 28, a chassis 100, and a ground engaging sole component 30, as shown in FIG. 1. In some cases, however, one or more of these components may be omitted.

Insole 26 may be disposed in the void defined by upper 14. Insole 26 may extend through each of regions 16, 18, and 20 and between the lateral and medial sides of footwear 10. Insole 26 may be formed of a deformable (for example, compressible) material, such as polyurethane foams, or other polymer foam materials. Accordingly, insole 26 may, by virtue of its compressibility, provide cushioning, and may also conform to the foot in order to provide comfort, support, and stability.

In some embodiments, insole 26 may be removable from footwear 10, for example, for replacement or washing. In other embodiments, insole 26 may be integrally formed with the footbed of upper 14. In other embodiments, insole 26 may be fixedly attached within footwear 10, for example, via permanent adhesive, welding, stitching, and/or another suitable technique.

In some embodiments of footwear 10, upper 14 may surround insole 26, including on an underside thereof. In other embodiments, upper 14 may not extend fully beneath insole 26, and thus, in such embodiments, insole 26 may rest atop midsole 28 (or atop chassis 100 in embodiments that do not include a midsole).

As noted above, footwear 10 is depicted in FIG. 1 as a soccer shoe. Although soccer shoes often do not include a midsole, since many features of footwear 10 may be applicable to shoes that do include a midsole (including soccer shoes as well as shoes for other activities), the general location of midsole 28 has been depicted in FIG. 1 as it may be incorporated into any of a variety of types of footwear (including soccer shoes if they do include midsoles). Midsole 28 may be fixedly attached to a lower area of upper 14 (for example, through stitching, adhesive bonding, thermal bonding (for example, welding), and/or other techniques), or may be integral with upper 14. Midsole 28 may extend through each of regions 16, 18, and 20 and between the lateral and medial sides of footwear 10. In some embodiments, portions of midsole 28 may be exposed around the periphery of footwear 10. In other embodiments, midsole 28 may be completely covered by other elements, such as material layers from upper 14. Midsole 28 may be formed from any suitable material having the properties described above, according to the activity for which footwear 10 is intended. In some embodiments, midsole 28 may include a foamed polymer material, such as polyurethane (PU), ethyl vinyl acetate (EVA), or any other suitable material that operates to attenuate ground reaction forces as sole structure 12 contacts the ground during walking, running, or other ambulatory activities.

Ground Engaging Sole Component

An article of footwear according to the present disclosure may include a sole structure including a ground engaging sole component fixedly attached to the upper. The sole component may include features that provide traction and stability on any of a variety of surfaces, and in any of a variety of conditions.

The sole component may be formed by any suitable process. For example, in some embodiments, the sole component may be formed by molding. In addition, in some embodiments, various elements of the sole component may be formed separately and then joined in a subsequent process. Those having ordinary skill in the art will recognize other suitable processes for making the sole components discussed in this disclosure.

The sole component may include a baseplate and one or more ground engaging members extending downward from the baseplate. The baseplate may include a substantially flat element that supports the foot, and serves as a substantially rigid platform from which the ground engaging members may extend.

Figure 2:
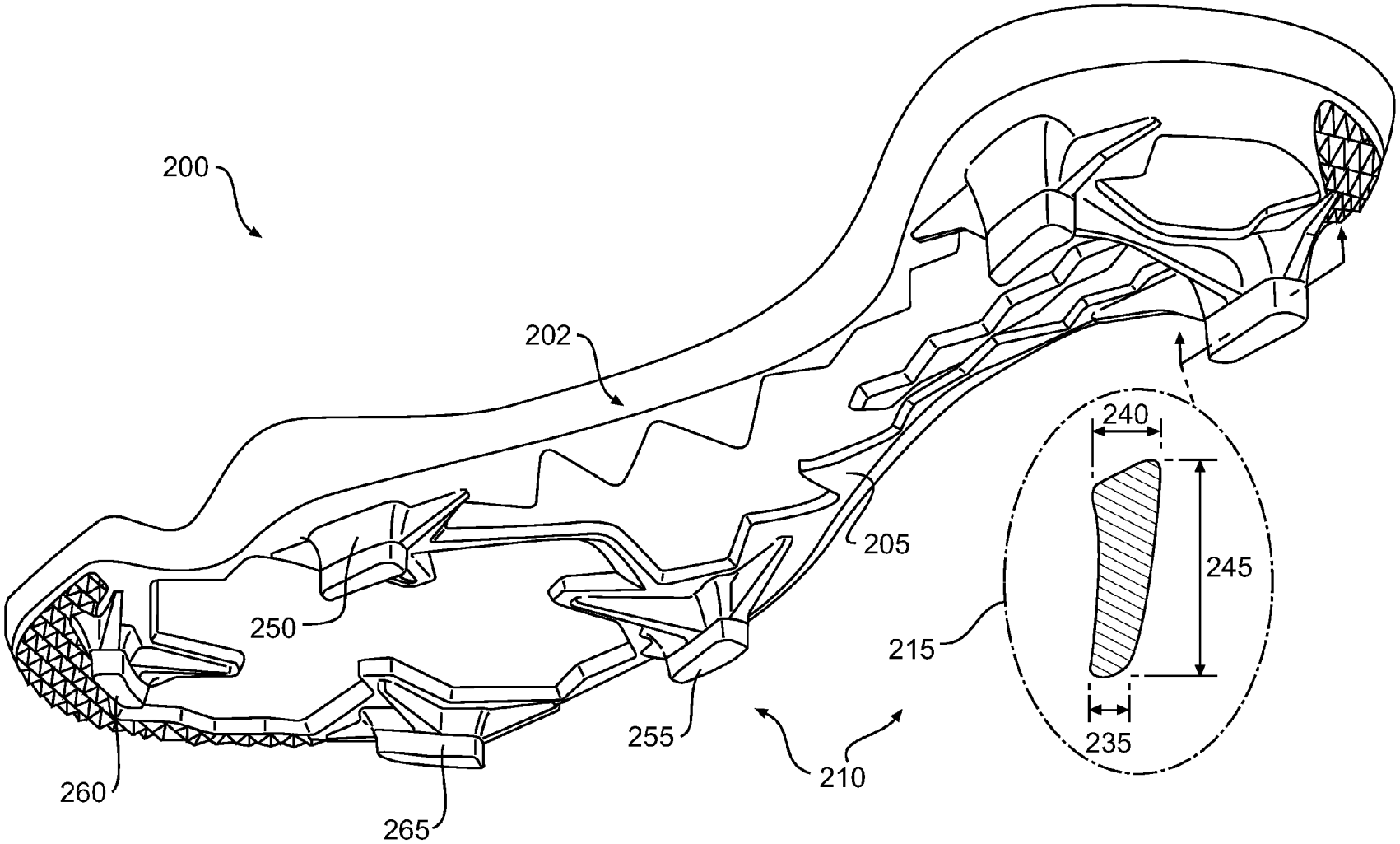
FIG. 2 is a schematic illustration of a perspective view of an exemplary ground engaging sole component as viewed from a lower, medial, rear perspective.

FIG. 2 is a bottom perspective view of a first exemplary embodiment of a ground engaging sole component 200 configured to be fixedly attached to an upper in order to form an article of footwear. FIG. 2 illustrates a bottom surface 205 of sole component 200 viewed from a rear-medial position.

Materials

The disclosed footwear components may be formed of any suitable materials. In some embodiments, one or more materials disclosed in Lyden et al. (U.S. Pat. No. 5,709,954), which is hereby incorporated by reference in its entirety, may be used.

The components of the disclosed baseplate may be formed of any of a variety of suitable materials. In some embodiments the baseplate, the ground engaging members, and other elements of the sole component may be integrally formed. For example, in some embodiments, the entirety of the sole component may be formed of a single material, forming all parts of the sole component. In such embodiments, the sole component may be formed all at once in a single molding process, for example, with injection molding.

Different structural properties may be desired for different aspects of the sole component. Therefore, the structural configuration may be determined such that, even though a common material is used for all portions of the sole component, the different portions may be stiffer, or more flexible due to different shapes and sizes of the components. For example, the heel and midfoot regions of the baseplate may be formed of a thicker material and/or may include reinforcing features, such as ribs, in order to provide stiffness to these portions of the sole component. Whereas, the forefoot region of the baseplate may be formed of a relatively thin material, in order to provide flexibility to the forefoot region. Greater flexibility in a forefoot region may enable natural flexion of the foot during running or walking, and may also enable the sole component to conform to surface irregularities, which may provide additional traction and stability on such surfaces. In addition, the ground engaging members may be formed with a thicker structure to provide rigidity and strength.

In other embodiments, different portions of the sole component may be formed of different materials. For example, a stiffer material, such as carbon fiber, may be utilized in the heel and/or midfoot regions of the baseplate, whereas a more flexible material, such as a thin polyurethane, may be used to form the forefoot region of the baseplate. In addition, it may be desirable to utilize a stiffer and/or harder material for the baseplate, such as carbon-fiber and/or polyurethane, and softer and more flexible material for the ground engaging members, such as a relatively hard rubber. Accordingly, in some embodiments, the sole component may be formed by multiple molding steps, for example, using a co-molding process. For instance, the baseplate may be pre-molded, and then inserted into a sole component mold, into which the ground engaging member material may be injected to form the ground engaging members, or portions of the ground engaging members.

Sole component 200 may be formed of suitable materials for achieving the desired performance attributes. Sole component may be formed of any suitable polymer, composite, and/or metal alloy materials. Exemplary such materials may include thermoplastic and thermoset polyurethane (TPU), polyester, nylon, polyether block amide, alloys of polyurethane and acrylonitrile butadiene styrene, carbon fiber, poly-paraphenylene terephthalamide (para-aramid fibers, e.g., Kevlar®), titanium alloys, and/or aluminum alloys. In some embodiments, sole component 200 may be formed of a composite of two or more materials, such as carbon-fiber and poly-paraphenylene terephthalamide. In some embodiments, these two materials may be disposed in different portions of sole component 200. Alternatively, or additionally, carbon fibers and poly-paraphenylene terephthalamide fibers may be woven together in the same fabric, which may be laminated to form sole component 200. Other suitable materials and composites will be recognized by those having skill in the art.

Baseplate

As shown in FIG. 2, sole component 200 may include a baseplate 202. Baseplate 202 may be a substantially flat, plate-like platform. Baseplate 202, although relatively flat, may include various anatomical contours, such as a relatively rounded longitudinal profile, a heel portion that is higher than the forefoot portion, a higher arch support region, and other anatomical features. In addition, baseplate 202 may include a bottom surface 205, which may be generally flat, but may have various contours that provide stiffness, strength, and/or traction.

Ground Engaging Members

Sole component 200 may include one or more ground engaging members 210 to provide traction and/or stability. It will be understood that a variety of types of ground engaging members could be implemented by sole component 200. Sole component 200 may include ground engaging members having any of a variety of shapes, sizes, and arrangements based on a number of factors. The configuration of ground engaging members utilized for sole component 200 may be based on the considerations discussed above, for example, the physical attributes of the player, the nature of the surface on which the activity is performed, and the conditions of that surface.

In some cases, ground engaging members 210 could be configured to engage a soft ground surface. For example, in one embodiment, ground engaging members 210 could be configured to engage a soft grass surface. In other cases, ground engaging members 210 could be configured to engage a hard surface. For example, in one embodiment ground engaging members 210 could be configured to engage a hard grass surface or artificial turf. In still other embodiments, other types of ground engaging members could be used.

The ground engaging members may be configured to provide traction and stability on any of a variety of surfaces, and in under any of a variety of surface conditions. As depicted in FIG. 2, sole component 200 equipped with ground engaging members 210 is a versatile sole structure, which may be suitable for a variety of surfaces. For example, the ground engaging members shown in the accompanying figures may be suited for a variety of relatively soft surfaces, such as natural or cushioned synthetic turf, relatively soft-packed dirt, and other compliant surfaces. However, the features shown and discussed in the present disclosure may also be applicable for relatively hard surfaces where cleated shoes may be utilized. Exemplary such surfaces may include, for example, relatively un-cushioned synthetic turf, hard-packed dirt or cinders, such as may be found on a baseball field or a running track, or synthetic rubber, such as may be found on other types of running tracks.

Further, while sole component 200 could be configured for any of various types of users, surfaces, and/or conditions, sole component 200 (and other presently disclosed sole component embodiments), as depicted in FIG. 2, is configured for speed and agility, and may be suitable for lighter weight athletes demonstrating, or looking to improve, speed and quickness. Sole component 200 shown in FIG. 2 (and other presently disclosed sole component embodiments) is depicted as a sole for a soccer shoe. However, such a sole configuration, either as shown or with minor modifications, could be utilized for other activities, such as baseball, football, and/or other activities.

Exemplary disclosed ground engaging members may have one or more features that facilitate ground penetration and/or ground extraction. Such features may include, for example, shapes, sizes, positioning on the sole component, as well as the orientation of the ground engaging members. For example, in some embodiments, the ground engaging members may have an elongate cross-sectional horizontal shape. Further, the elongate shape may be narrower at one end or the other. Such a narrower end may facilitate ground penetration in the way a pointed implement is configured for ground penetration. In addition, a narrower end may also facilitate ground extraction (that is, the removal of the ground engaging member from the ground after penetration).

As shown in FIG. 2, in some embodiments, ground engaging members 210 may have a horizontal cross-sectional shape that is substantially elongate. For example, as shown in cross sectional view 215 in FIG. 2, ground engaging members 210 may have a cross-sectional shape similar to an airfoil. In some embodiments, an airfoil shape may be formed by virtue of having a slight curvature, as shown in the figures, as well as differing widths at the front and rear of the ground engaging member. For example, as shown in cross-sectional view 215 in FIG. 2, ground engaging members 210 may have a forward width 235 and a rearward width 240, wherein forward width 235 is narrower than rearward width 240.

In some embodiments, forward width 235 may be approximately 0.5-4.0 mm, whereas rearward width 240 may be approximately 3.0-8.0 mm. These dimensions may vary depending upon the portion of sole component 200 on which the ground engaging member is disposed. For example, in some embodiments, a forefoot ground engaging member may have a forward width 235 that is approximately 2.0 mm, and a rearward width 240 that is approximately 5.0 mm. In contrast, in some embodiments, a heel ground engaging member may have a forward width 235 that is approximately 4.0 mm, and a rearward width 240 that is approximately 6.5 mm.

Exemplary elongate ground engaging members 210 may have a length 245 that is substantially longer than either forward width 235 or rearward width 240. For example, in some embodiments, length 245 may be in the range of approximately 10.0-30.0 mm (1-3 cm). For example, in some embodiments, forefoot ground engaging members may have a length 245 of approximately 16 mm. This exemplary length 245 is at least three times larger than the width of any portion of the exemplary forefoot ground engaging member dimensions mentioned above. Also, in some embodiments, heel ground engaging members may have a length 245 of approximately 20 mm. This exemplary length 245 is also at least three times larger than the width of any portion of the exemplary heel ground engaging member mentioned above.

Figure 3A:
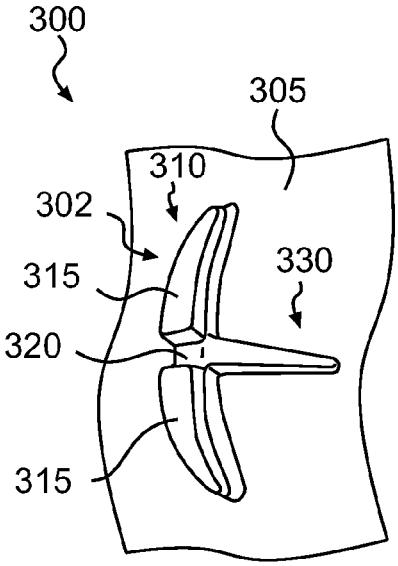
FIG. 3A is a schematic illustration of a bottom, partial perspective view of an exemplary tread configuration including a ground engaging member with an elongate support member.
Figure 3B:
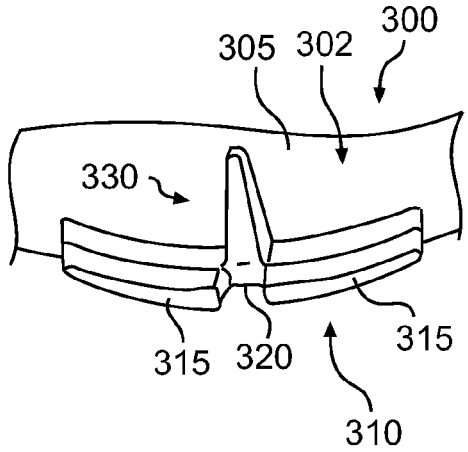
FIG. 3B is a schematic illustration of a side perspective view of the tread configuration shown in FIG. 3A.

Other elongate shapes are also possible, such as oval, rectangular, racetrack, and others. For example, FIGS. 3A and 3B show an alternative elongate ground engaging member embodiment. FIGS. 3A and 3B show a ground engaging sole component 300, including a baseplate 302 having a bottom surface 305, and a substantially curved ground engaging member 310. The radius of curvature of ground engaging member 310 may be substantially smaller than the radius of curvature of airfoil-shaped ground engaging members 210. That is, ground engaging member 310 may be more tightly curved than ground engaging member 210, as shown. However, any suitable curvature may be used for ground engaging members.

Exemplary ground engaging members may also include features that provide additional traction in a region of the foot. For example, additional traction may be desired in a region of a shoe corresponding with the first distal phalanx of the foot. In some embodiments, a ground engaging member may be utilized in this region that has a substantially longer length. In such embodiments, a ground engaging member may include dual downward projections. By splitting the lengthened ground engaging member into dual projections, ground penetration may be improved over a single long projection. In addition, dual projections may be utilized to affect weight distribution among ground engaging members.

Referring again to FIGS. 3A and 3B, ground engaging member 310 may include dual projections 315 with a bridge 320 between dual projections 315. A ground engaging member having the configuration of ground engaging member 310 may be incorporated at any suitable location on a ground engaging sole component.

Figure 4A:
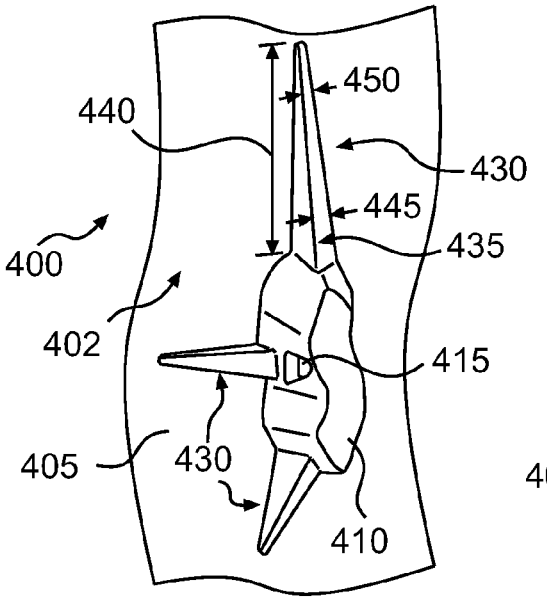
FIG. 4A is a schematic illustration of a bottom, partial perspective view of an exemplary tread configuration including a ground engaging member with elongate support members.
Figure 4B:
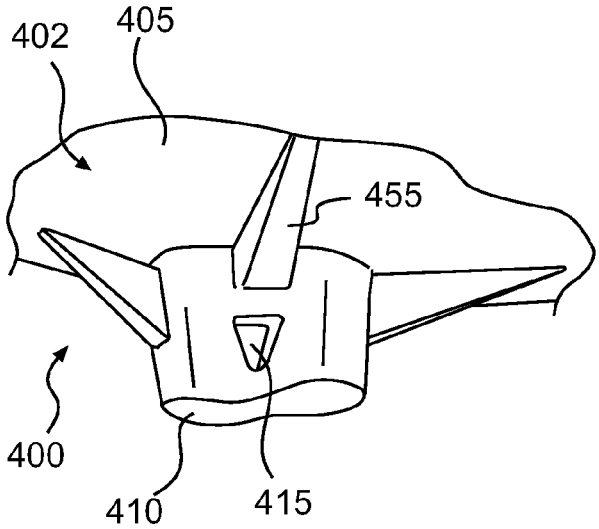
FIG. 4B is a schematic illustration of a bottom perspective view of the tread configuration shown in FIG. 4A.

In some embodiments, the cross-sectional shape of ground engaging members 210 may be substantially irregular. For example, FIGS. 4A and 4B show an alternative ground engaging member embodiment. FIGS. 4A and 4B show a ground engaging sole component 400, including a baseplate 402 having a bottom surface 405, and a ground engaging member 410 having a tilde-shaped horizontal cross-sectional shape.

Some embodiments may include ground engaging members having features that facilitate weight reduction of the ground engaging sole component. For example, some ground engaging members may have holes passing through the ground engaging member, thus eliminating extra material without substantially reducing strength or rigidity. For Example, referring again to FIGS. 4A and 4B, in some embodiments, ground engaging members 410 may include holes 415 passing through ground engaging members 410. Ground engaging members having weight-reducing holes may be utilized in any suitable locations on a sole component. Exemplary such locations may include places where larger ground engaging members are disposed. For example, heel regions often have longer cleats in order to accommodate a raised heel region of the sole component as discussed above. See, for example, FIG. 20. In addition, regions where ground engaging members have been grouped closely, or where a dual projection ground engaging member, such as ground engaging member 310 shown in FIGS. 3A and 3B, may utilize holes in the ground engaging members to reduce the amount of weight clustered in that region of the shoe. See FIG. 19.

Ground engaging members may also have a substantially regular cross-sectional shape. For example, in some embodiments, ground engaging members may have a circular cross-sectional shape. Circular ground engaging members may be less costly to produce, and may also provide relatively even traction in all horizontal directions. Circular round engaging members may also provide traction, while still allowing rotation of a foot about the circular ground engaging member while in contact with the ground. This may facilitate pivoting on a planted foot, which may, in turn, enable rapid changes in direction by the athlete, and promote freedom of motion.

Figure 5:
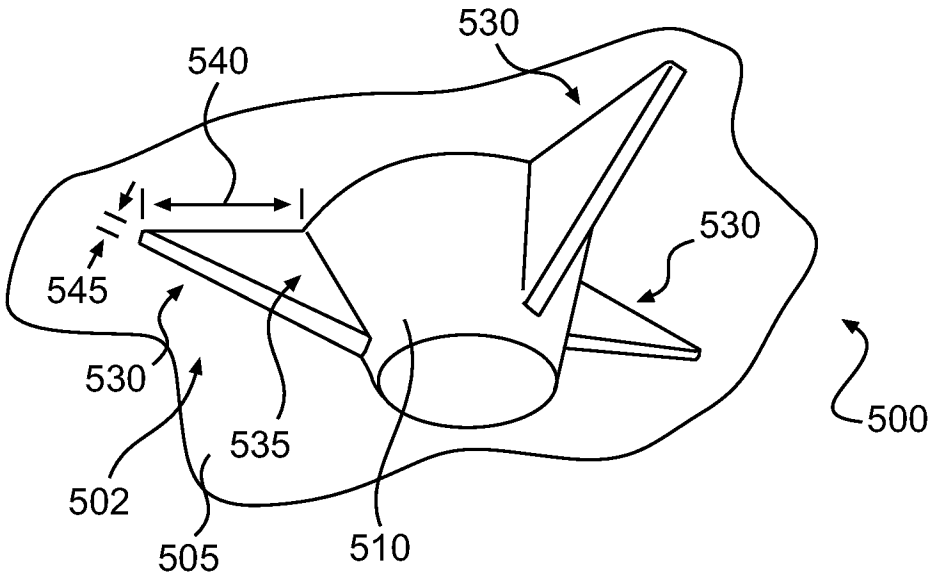
FIG. 5 is a schematic illustration of a bottom perspective view of an exemplary tread configuration including a ground engaging member with elongate support members.

FIG. 5 illustrates an alternative ground engaging member embodiment. For example, FIG. 5 shows a ground engaging sole component 500, which may include a baseplate 502 having a bottom surface 505, and a ground engaging member 510 having a substantially round cross-sectional shape. In some embodiments, ground engaging member 510 may be substantially conical, as shown in FIG. 5. Substantially round ground engaging members may be utilized at any suitable location of a sole component. In some embodiments, round ground engaging members may be disposed at a region of the sole component corresponding with the first metatarsal head region of the wearer's foot and/or at the region of the foot corresponding with the distal portion of the first phalanx. See, for example, FIG. 19. An athlete may place a significant amount of their weight on these regions of their foot when pivoting. Therefore, placement of round ground engaging members at these locations may facilitate pivoting, while still maintaining traction.

Support Members

In addition to ground engaging members, a ground engaging sole component may include one or more features to provide reinforcement to the ground engaging members, increase traction, and facilitate ground penetration and extraction. In some embodiments the ground engaging sole component may include one or more elongate support members extending downward from the bottom surface of the baseplate of the sole component, abutting the side portions of the ground engaging members, and extending horizontally from the ground engaging members. Examples of such elongate support members are disclosed in co-pending U.S. application Ser. No. 13/009,549, filed Jan. 19, 2011, entitled "Composite Sole Structure," the disclosure of which is hereby incorporated by reference in its entirety; and co-pending U.S. application Ser. No. 12/582,252, filed Oct. 20, 2009, entitled "Article of Footwear with Flexible Reinforcing Plate," the disclosure of which is hereby incorporated by reference in its entirety.

By spanning between ground engaging members and the bottom surface of the baseplate, elongate support members may buttress, brace, or otherwise reinforce the ground engaging members. This may provide reinforcement, such as, for example, increased stiffness and/or strength to the ground engaging members.

The amount of reinforcement provided by the elongate support members may be dependent on the shape, size (length, height, thickness), material, placement, and or orientation of the support members. The amount of reinforcement provided may also depend on the number of support members used on each ground engaging member. The foregoing parameters may be varied to achieve the desired level of reinforcement for a given ground engaging member. In some cases, weight may be reduced by using a thinner, lighter weight ground engaging member, while the strength and stiffness of the ground engaging member may be maintained by the inclusion of one or more elongate support members, which may provide the same amount of strength and stiffness using less material.

Similarly, the reduction of material from the ground engaging members may increase ground penetration. For example, when elongate support members are used, the cross-section of the ground engaging members may be reduced, allowing for increased ground penetration. The addition of the support members provides little, if any, additional impedance to ground penetration because the support members are relatively thin, and thus readily penetrate the ground. In addition, the support members may be configured such that they do not extend the full length of the ground engaging members, thus, a significant portion of the ground engaging members may penetrate the ground before the support members even engage the ground. Also, the support members may have a sloped configuration, which may also facilitate ground penetration of the support members themselves.

In addition to reinforcement and ground penetration, the elongate support members may provide increased traction. As additional elements that extend from the bottom surface of the sole component baseplate, the support members may serve as secondary traction elements. In addition, because the support members may be elongate, the traction provided, like the reinforcement, is substantially directional. That is, an elongate support member provides the most traction in a direction perpendicular to the direction in which it is elongated. Thus, the orientation of each elongate support member may be selected to provide traction in a desired direction at a desired region of the ground engaging sole component. Accordingly, additional traction may be provided specifically in a longitudinal (forward-rearward) direction or a lateral (lateral-medial) direction, or at any angle between longitudinal and lateral. It is noted that the direction in which an elongate support member provides the most reinforcement is perpendicular to the direction in which it provides the most traction. This factor may be considered when selecting support member configurations.

By extending one or more elongate support members substantially radially (or at other angles) from a ground engaging member, torsional traction may be provided about the ground engaging member. Torsional traction is a characteristic that may be either desirable or undesirable depending on the application. For example, for certain activities, it may be beneficial to have greater freedom of motion. Accordingly, for such activities, a reduced size and/or number of support members may be utilized at regions of the foot that may serve as pivot points during the activity. For other activities, it may be desirable to provide increased torsional traction in order to increase performance. For example, it may be advantageous to provide a golf shoe with increased torsional traction at certain portions of the foot, in order to enable a golfer to generate more torque by twisting his body during a swing.

In some cases, it may be advantageous on one foot to provide increased torsional traction, and on the other foot to provide decreased torsional traction. For example, while a golfer may want additional torsional traction at one or more portions of his rear foot (away from the hole) to enable him to execute a more powerful swing, he may want a reduced amount of torsional traction at one or more portions on his front foot (closer to the hole), to enable greater freedom of motion. Depending on the portion of the foot in question, the opposite may also be true. That is, it may be desirable to provide one or more portions of the rear foot with a reduced amount of torsional traction and provide one or more portions of the front foot with an increased amount of torsional traction.

Torsional traction systems may be advantageous for any type of activity where it would be beneficial to generate torque with the body. For example, increased agility may be provided by enabling increased torque to be generated when changing directions. In addition, other exemplary such activities may involve asymmetric motions, such as throwing, swinging, kicking, and other motions. Therefore, exemplary applications where torsional traction systems could be implemented may include, for example, golf (as noted above), baseball (both hitting and throwing), javelin, soccer (both kicking).

The foregoing outlines a multitude of parameters regarding the structural configuration of support members that may be manipulated to provide desired reinforcement, ground penetration, and traction characteristics at specific locations of the sole of an article of footwear. Accordingly, the shape, size, material, placement, orientation, and other specifications of each individual support member may be chosen to achieve the desired performance characteristics. This customization of multiple components of a cleat system is reflected in the asymmetric and irregular support member configurations in the disclosed embodiments. It is noted that, as illustrated in the accompanying figures and described in greater detail below, the shape, size, orientation, and other parameters of support members may be inconsistent among ground engaging members in the same sole structure embodiment. Further, it should also be noted that, such variation may also exist among support members about a common ground engaging member.

In addition, the configuration of support members may also be varied according to the size of the article of footwear. For example, larger sizes of footwear may use a similar arrangement of ground engaging members. However, for larger shoe sizes (e.g., box sizes), the spacing between the ground engaging members may be significantly greater. Across a size range, the spacing between a forefoot ground engaging member and a heel ground engaging member may vary by several centimeters. In order to provide additional traction in the larger spaces between ground engaging members for larger shoe sizes, longer support members and/or support members having an alternative shape may be utilized between the ground engaging members. Similarly, it may be advantageous to alter the configuration of support members by selectively reducing the size of the support members in certain areas. For example, in some embodiments, smaller sizes may include support members that effectively bridge the entire gap between ground engaging members by spanning between the members. However, for larger sizes, the distance between two ground engaging members may be much larger such that a support member that extends the full gap between the ground engaging members may provide a level of traction that exceeds the desired amount. In such cases, it may be beneficial to omit the central portion of the bridging support member for larger size footwear.

Shape of Support Members

The shape of support members may provide reinforcement, ground penetration, and traction. The elongate configuration of support members is discussed above as providing directional reinforcement, directional traction, and ground penetration and extraction. In addition, in some embodiments, other aspects of the support member shape may influence these characteristics.

Figure 6A:
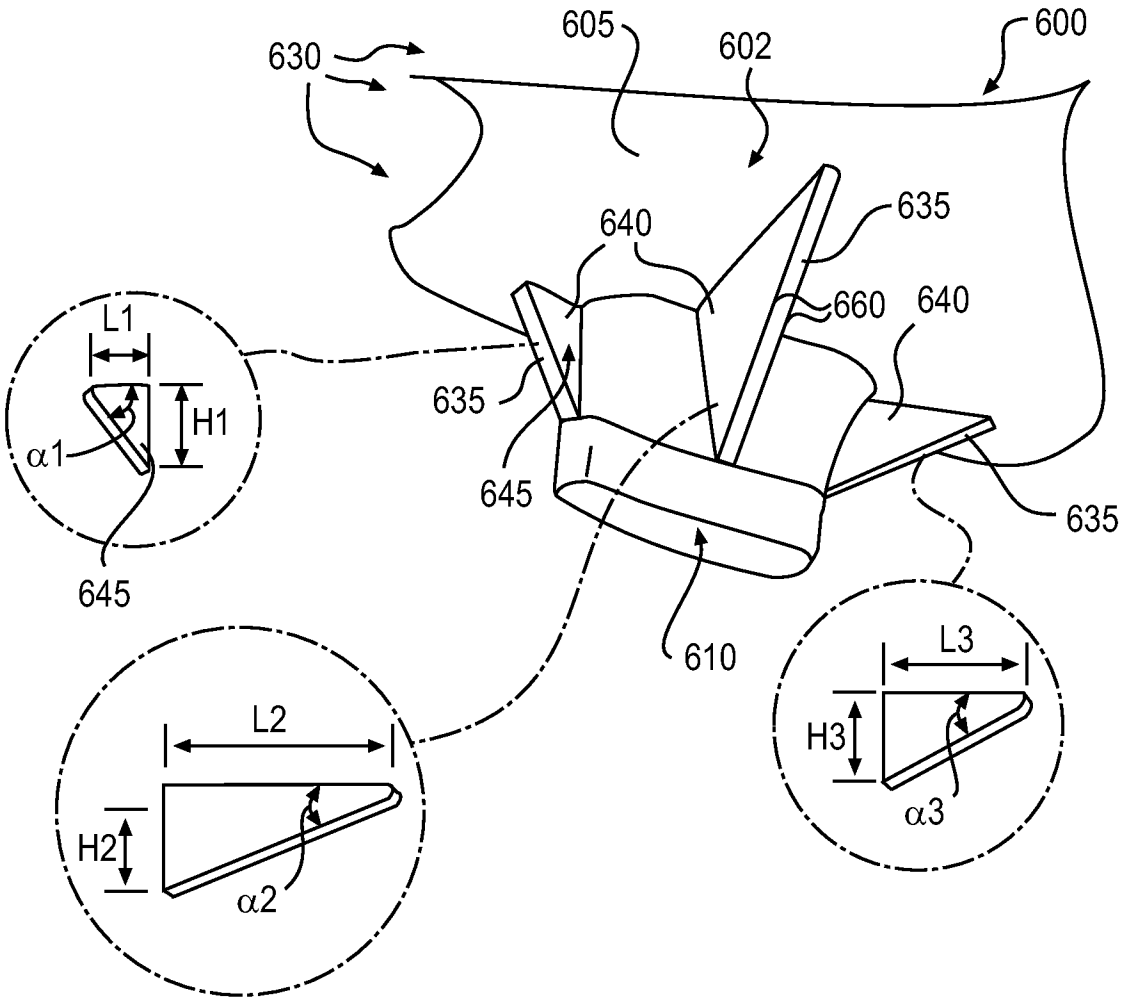
FIG. 6A is a schematic illustration of a bottom perspective view of an exemplary tread configuration including a ground engaging member with elongate support members.

FIG. 6A illustrates an exemplary support member configuration. As illustrated in FIG. 6A, a ground engaging sole component 600 may include a baseplate 602 having a bottom surface 605, and a ground engaging member 610 extending downward from bottom surface 605. Sole component 600 may also include one or more elongate support members 630 extending substantially downward from bottom surface 605 of baseplate 602, abutting ground engaging member 610 at side portions thereof, and extending horizontally from the side portions of ground engaging member 610.

In some embodiments, one or more of elongate support members 630 may include a downward facing surface 635 that is substantially planar. It may be more cost effective to produce support members with planar downward facing surfaces, as the molds may be simpler to make. In addition, the mechanical properties of support members having planar downward facing surfaces may also be simpler to calculate, which may facilitate the process of developing a tread system with the desired properties. Further, edges 660 between downward facing surfaces 635 and vertical surfaces 640 of support members 630 may provide additional traction over and above alternative shapes, such as rounded downward facing surfaces.

In some embodiments, support members may have downward facing surfaces that are sloped, for example, extending at angles between the ground engaging members to the bottom surface of the baseplate at locations that are relatively near, but spaced from, the ground engaging member. These angles may be varied from support member to support member and/or from ground engaging member to ground engaging member. Further, in some embodiments, a single ground engaging member may have a faceted downward facing surface, wherein each facet is oriented at a different slope angle.

Different slope angles may provide different levels of reinforcement by virtue of having the support provided at differing angles, as well as by influencing the size of the support member. In addition, slope angles may also affect ground penetration, with steeper angles providing better ground penetration. In some embodiments, faceted downward facing surfaces may have their steepest portions (closest to vertical) nearest the ground engaging member to which it is abutted. These portions that are closest to the ground engaging members are furthest from the bottom surface of the baseplate and, therefore, are the portions of the support members that extend the furthest downward. Accordingly, as the sole component comes into contact with the ground, these portions engage the ground before (and therefore in more circumstances than) the portions of the support members that are disposed further away from the ground engaging members. In addition, the dual angles of a support member may enable the traction provided by the support members to be focused in the areas immediately surrounding the ground engaging members, while still providing additional reinforcement due to the wider extension of the portions of the support members closer to the baseplate in directions horizontally away from the ground engaging members.

It should be noted that the isolated depictions of first elongate support member 645, second elongate support member 650, and third elongate support member 655 in FIG. 6A are schematic and are provided for dimensional illustration. While these components could be implemented having shapes substantially as shown (with profiles of right triangles), in some embodiments, the side portions that abut the ground engaging member may have some degree of curvature in conformity with the shape of the ground engaging member, which can flare at a top portion where it abuts the bottom surface of the baseplate.

In some embodiments, downward facing surfaces 635 may extend at slope angles from the side portions of ground engaging members 630 to bottom surface 605 of baseplate 602 proximate to ground engaging members 630. In some embodiments, downward facing surfaces 635 of elongate support members 630 may have slope angles that differ from one another. For example, sole component 600 may include a first elongate support member 645, a second elongate support member 650, and a third elongate support member 655. As shown in FIG. 6A, first elongate support member 645, second elongate support member 650, and third elongate support member 655 may each have a different shape and/or size and, accordingly, may have downward facing surfaces extending at different slope angles. For example, elongate support member 645 may have a first height H1, a first length L1, and a first slope angle $\alpha$1 measured with respect to horizontal. In addition, second elongate support member 650 may have a second height H2, a second length L2, and a second slope angle $\alpha$2. Further, third elongate support member 655 may have a third height H3, a third length L3, and a third slope angle $\alpha$3. Exemplary approximate dimensions for the foregoing components are provided in the table shown in FIG. 6B.

Figure 7:
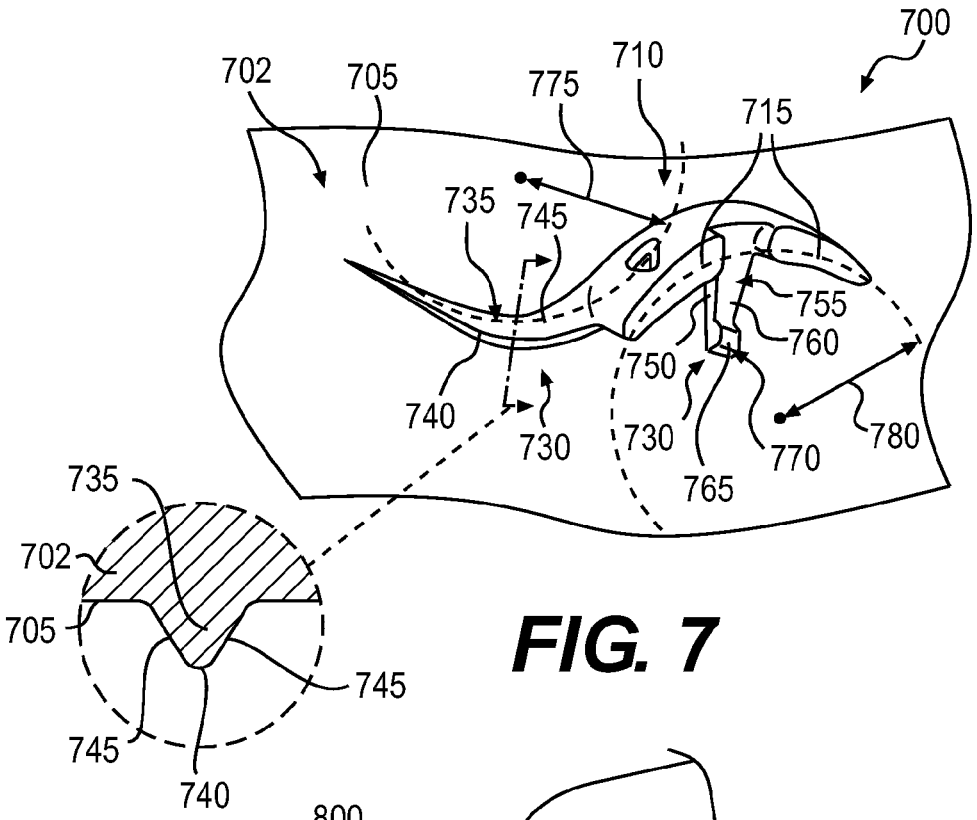
FIG. 7 is a schematic illustration of a bottom, partial perspective view of an exemplary tread configuration including a ground engaging member with elongate support members.

FIG. 7 illustrates an alternative exemplary support member configuration. As shown in FIG. 7, a ground engaging sole component 700 may include a baseplate 702 having a bottom surface 705, and a ground engaging member 710 extending downward from bottom surface 705. Sole component 700 may also include one or more elongate support members 730 extending substantially downward from bottom surface 705 of baseplate 702, abutting ground engaging member 710 at side portions thereof, and extending horizontally from the side portions of ground engaging member 710. A peaked downward facing surface may facilitate ground penetration of a support member.

In some embodiments, sole component 700 may include a peaked elongate support member 735. As shown in FIG. 7, peaked elongate support member 735 may have a downward facing surface 740 at least a portion of which is substantially peaked. That is peaked elongate support member 735 may have a downward ridge 740 at which opposing faces of downward facing surface 745 may intersect.

Figure 8:
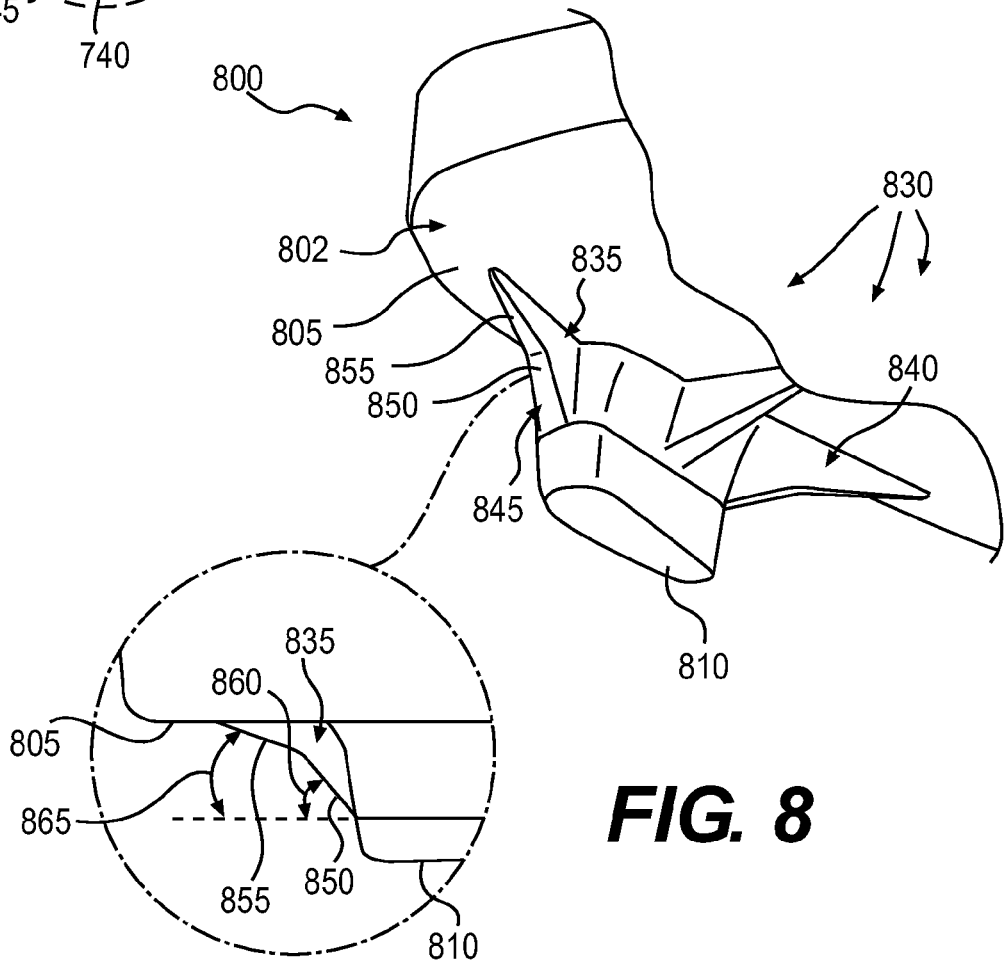
FIG. 8 is a schematic illustration of a bottom perspective view of an exemplary tread configuration including a ground engaging member with elongate support members.

FIG. 8 illustrates an alternative support member configuration. FIG. 8 shows a ground engaging sole component 800, which may include a baseplate 802 having a bottom surface 805, and a ground engaging member 810 extending downward from bottom surface 805. Sole component 800 may also include one or more elongate support members 830 extending substantially downward from bottom surface 805 of baseplate 802, abutting ground engaging member 810 at side portions thereof, and extending horizontally from the side portions of ground engaging member 810.

In some embodiments, one or more of elongate support members 830 may include a downward facing surface that is faceted. As shown in FIG. 8, the downward facing surface may be faceted, such that each facet extends at a different slope angle. For example, sole component 800 may include a first elongate support member 835 and a second elongate support member 840. First elongate support member 835 may have a downward facing surface 845.

In some embodiments, downward facing surface 845 may be faceted. Downward facing surface 845 may include a first facet 850 and a second facet 855. In some embodiments, first facet 850 and second facet 855 may be substantially planar. As shown in FIG. 8, first facet 850 and second facet 855 may be angled at different non-horizontal orientations. That is, first facet 850 and second facet 855 may extend at different slope angles. For example, first facet 850 may extend horizontally and upward from ground engaging member 810 at a first slope angle 860, and second facet 855 may extend horizontally and upward at a second slope angle 865.

In some embodiments, slope angles 860 and 865 may be different. Further, in some embodiments, slope angles 860 and 865 may both extend at different non-horizontal orientations, as shown in FIG. 8. In some embodiments, wherein first facet 850 is disposed adjacent ground engaging member 810 and between ground engaging member 810 and second facet 855, first slope angle 860 may be steeper (closer to vertical) than second slope angle and 865, as shown in FIG. 8.

The advantages of having support members that are elongate are discussed in detail above. The degree to which a support member is elongate is related to the thickness or horizontal width of the support member. This thickness may vary from support member to support member and/or from ground engaging member to ground engaging member. Further, the thickness of each support member may be consistent along its length or may vary. For example, in some embodiments, the thickness may taper with distance from the ground engaging member to which the support member abuts.

Referring again to FIG. 4A, in some embodiments, the elongate support member may taper with distance from the ground engaging member. For example, sole component 400 may include one or more elongate support members 430. A first elongate support member 435 may include a horizontal length 440. In addition, first elongate support member 435 may have a first horizontal width 445 (thickness) at an end proximal to ground engaging member 410, and a second horizontal width 450 further away from ground engaging member 410. In some embodiments, second horizontal width 450 may be narrower than first horizontal width 445, and thus, may taper with distance from ground engaging member 410.

Tapering support members may provide benefits in ground penetration and extraction. As a ground engaging member penetrates the ground, the force required to create further penetration may increase. The added force required may be greater still if additional parts of the sole component (such as support members) come into contact with the ground as primary ground engaging members penetrate. In some cases, it may be desirable to facilitate deeper ground penetration, while maintaining the benefits of support members. In such cases, it may be advantageous to provide support members with tapered profiles, in order to better enable ground penetration of the uppermost portions of the support members.

Referring again to FIG. 5, sole component 500 may include one or more elongate support members 530. A first elongate support member 535 may have a horizontal length 540 and a horizontal width 545 (thickness). In some embodiments, horizontal width 545 may be substantially the same over the entire horizontal length 540 of first elongate support member 535.

It may be beneficial to form support members with a consistent horizontal width in order to simplify manufacturing. A consistent thickness may also provide consistent traction and ground penetration related to the thickness, allowing traction and ground penetration to be determined by other factors, such as slope angle, orientation, and size of the support member.

Some embodiments may include an elongate support member that has a lowermost surface that extends, over a first distance, substantially horizontally away from the ground engaging member to which it abuts. In some such embodiments, the support member may project further downward over a second distance to form a second ground engaging member.

Referring again to FIG. 7, sole component 700 may include a second elongate support member 750. Second elongate support member 750 may include a lowermost surface 755. As shown in FIG. 7, second elongate support member 750 may include a first portion 760 wherein lowermost surface 755 extends substantially horizontally away from ground engaging member 710. In addition, second elongate support member 750 may include a second portion 765 wherein lowermost surface 755 projects further downward to form a second ground engaging member 770.

By providing a second ground engaging member depending from a support member, ground engaging members may be clustered in a particular area of the sole component. In addition, both the first and second ground engaging members may benefit from the reinforcement provided by the support member.

In some embodiments, one or more of the elongate support members may have a curvature as it extends horizontally from the ground engaging member to which it abuts. As shown in FIG. 7, peaked elongate support member 735 extends horizontally from ground engaging member 710 in a direction having a curvature. Peaked elongate support member 735 may have a first radius of curvature 775. In addition, ground engaging member 710 may have a second radius of curvature 780. As shown in FIG. 7, the curvature of peaked elongate support member 735 may differ from the curvature of ground engaging member 710. In addition, in some embodiments, the curvature of peaked elongate support member 735 and the curvature of the ground engaging member 710 may be reversed, as also depicted in FIG. 7. Curved ground engaging members and/or curved elongate support members may be applicable for use in any suitable location. For example, such curved components may be suitable for use in regions of the foot that are curved, such as at the junction between the arch of the foot and the first metatarsal head.

Orientation of Support Members

While the amount of reinforcement, ground penetration, and/or traction may be controlled by varying the shape of the support members, as discussed above, the direction in which the reinforcement and traction may be provided may also be controlled. Each elongate support member may provide reinforcement and traction in multiple directions. However, due to the elongate structure, each elongate support member may provide the most reinforcement in the direction of its elongation. For example, an elongate support member that extends medially from a ground engaging member may provide the greatest reinforcement in the lateral and medial directions. Such a support member may, additionally, provide reinforcement in forward and rearward directions, albeit to a lesser degree. Thus, the direction of reinforcement provided by the elongate support members may be controlled by selecting the orientation of the support member. Similarly, the direction of greatest traction provided by support members may be substantially perpendicular to the direction of elongation.

In some embodiments, one or more support members may extend substantially radially from an approximate center portion of a ground engaging member. In some embodiments, one or more support members may extend in a substantially non-radial direction. In some embodiments, all support members abutting the same ground engaging member may extend radially from the ground engaging member. In some embodiments, all support members abutting the same ground engaging member may extend in a substantially non-radial direction. Further, in some embodiments, both radially and non-radially oriented support members may abut the same ground engaging member.

Figure 9:
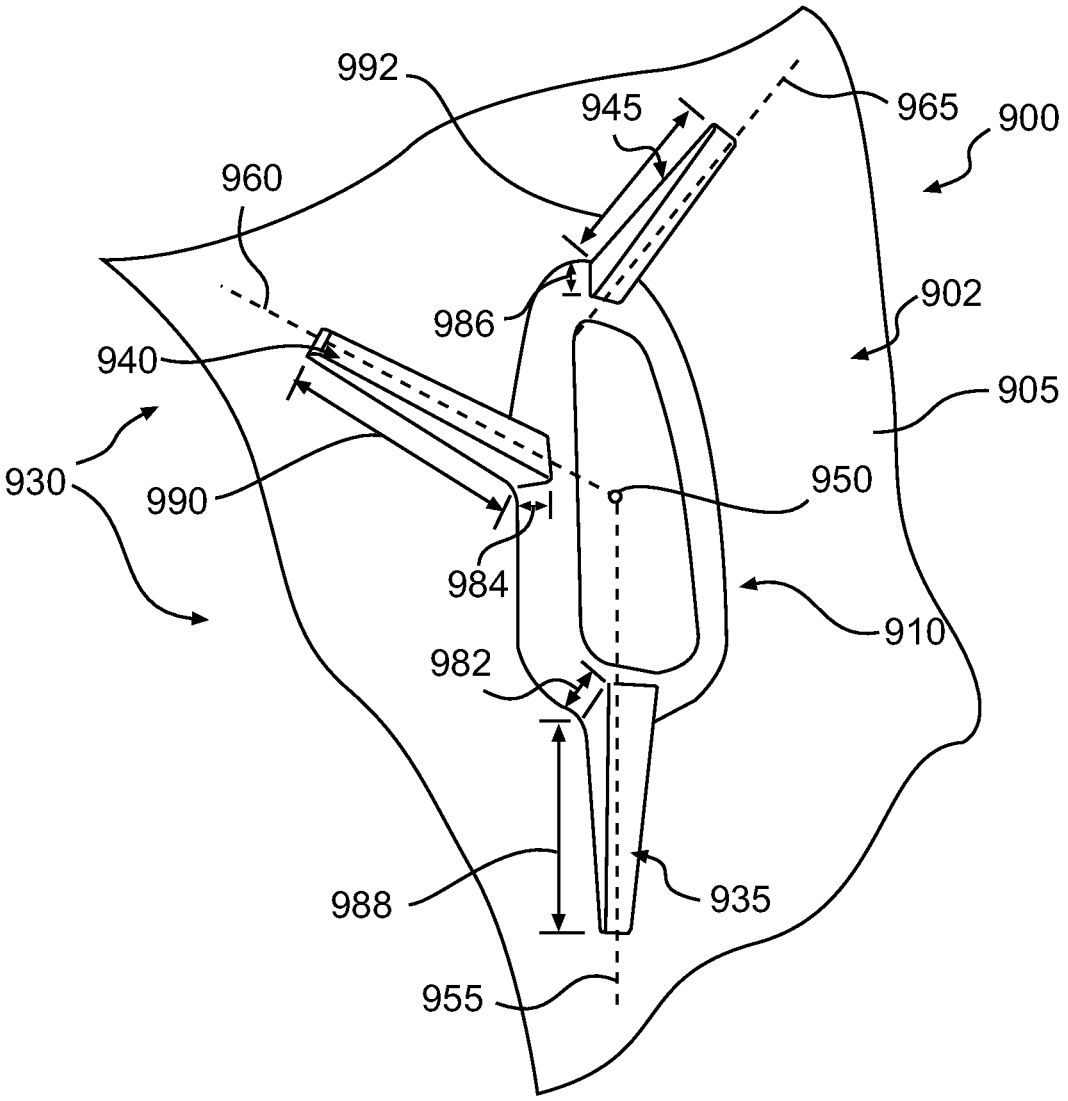
FIG. 9 is a schematic illustration of a bottom, partial perspective view of an exemplary tread configuration including a ground engaging member with elongate support members.

FIG. 9 is a bottom view of a portion of a ground engaging sole component 900. Sole component 900 may include a baseplate 902 having a bottom surface 905. Sole component 900 may also include a ground engaging member 910. As shown in FIG. 9, ground engaging member 910 may have a substantially elongate horizontal cross-sectional shape. Sole component 900 may further include one or more elongate support members 930. For example, as shown in FIG. 9, sole component 900 may include a first elongate support member 935, a second elongate support member 940, and a third elongate support member 945. As shown in FIG. 9, first elongate support member 935 and second elongate support member 940 may extend substantially radially from an approximate center portion 950 of ground engaging member 910.

Center portion 950 is intended to reflect an approximation of the center of ground engaging member 910. In some embodiments, the approximate center portion may relate to the geometric center (centroid) of the ground engaging member. In other embodiments, the center portion may simply be the intersection of lines bisecting the length and width of the ground engaging member. As noted above, however, the center portion is not necessarily intended to be a precise center point according to any particular convention, although it could be in some embodiments. Rather, the center portion is intended to be approximate and is utilized in this description to differentiate between support members that are oriented substantially radially and support members that have a substantially non-radial orientation.

As shown in FIG. 9, first elongate support member 935 may extend along a first radial axis 955. Second elongate support member 940 may extend along a second radial axis 960. First radial axis 955 and second radial axis 960 may intersect center portion 950. Third elongate support member 945 may extend along a substantially non-radial axis 965. As shown in FIG. 9, non-radial axis 965 does not intersect with center portion 950. The use of radial and/or non-radial support members may be based on considerations discussed above regarding reinforcement, ground penetration and extraction, and traction, including the directionality of each of these properties.

Figure 10:
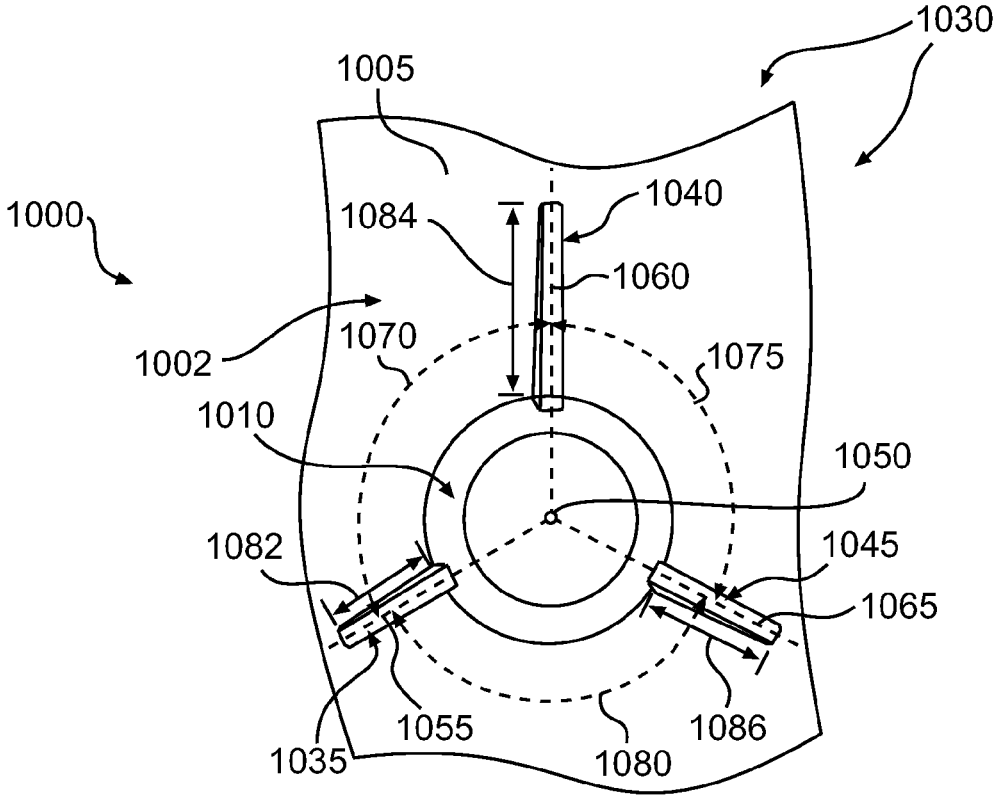
FIG. 10 is a schematic illustration of a bottom, partial perspective view of an exemplary tread configuration including a ground engaging member with elongate support members.

In some embodiments, all support members abutting the same ground engaging member may be radially oriented. In addition, both radial and non-radial support members may abut ground engaging members having any horizontal cross-sectional shape. FIG. 10 illustrates an alternative support member configuration. FIG. 10 is a bottom view of a portion of a ground engaging sole component 1000. Sole component 1000 may include a baseplate 1002 having a bottom surface 1005. Sole component 1000 may also include a ground engaging member 1010. As shown in FIG. 10, ground engaging member 1010 may have a substantially round (circular) cross-sectional shape.

Sole component 1000 may further include one or more elongate support members 1030. For example, as shown in FIG. 10, sole component 1000 may include a first elongate support member 1035, a second elongate support member 1040, and a third elongate support member 1045. As shown in FIG. 10, first elongate support member 1035, second elongate support member 1040, and third elongate support member 1045 may all extend substantially radially from an approximate center portion 1050 of ground engaging member 1010. For example, as shown in FIG. 10, first elongate support member 1035 may extend along a first radial axis 1055. In addition, second elongate support member 1040 may extend along a second radial axis 1060, and third elongate support member 1045 may extend along a third radial axis 1065. First radial axis 1055, second radial axis 1060, and third radial axis 1065 may all intersect center portion 1050.

In some embodiments, wherein the ground engaging member is elongate, support members may be selectively oriented to be either in substantial alignment or substantial non-alignment with the direction in which the ground engaging member is elongated. The alignment of support members with elongate ground engaging members may vary from support member to support member and/or from ground engaging member to ground engaging member. For example, in some embodiments support members may be consistently aligned or non-aligned about a common ground engaging member to which all the support members are abutted. In some embodiments, support members may be consistently aligned or non-aligned throughout an arrangement of ground engaging members. In other embodiments, both aligned and non-aligned support members may be implemented in the same arrangement of ground engaging members and/or even about the same ground engaging member.

Figure 11:
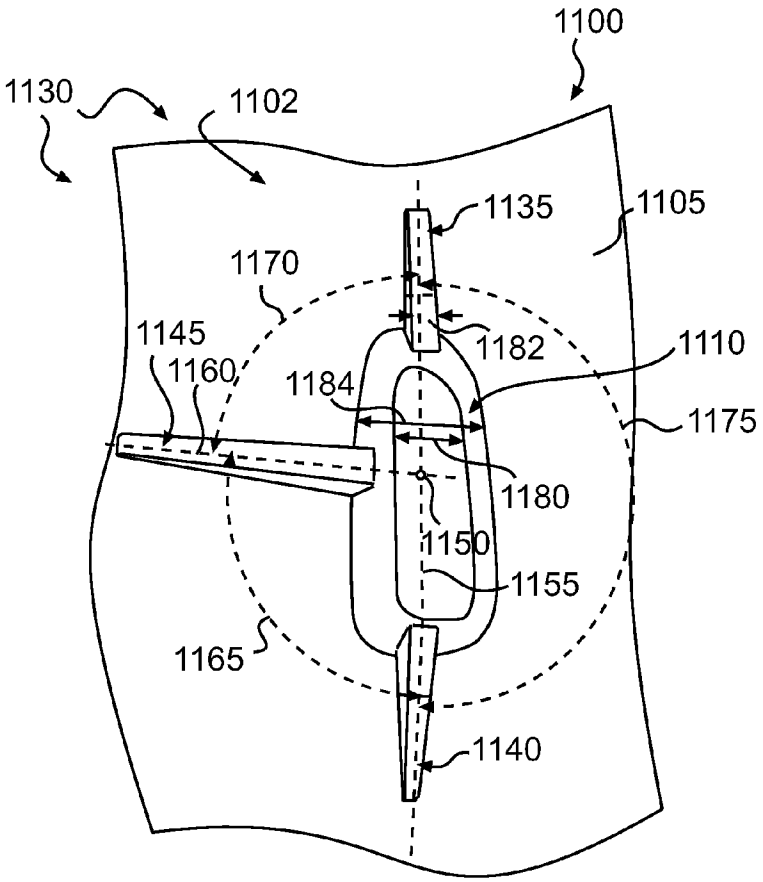
FIG. 11 is a schematic illustration of a bottom, partial perspective view of an exemplary tread configuration including a ground engaging member with elongate support members.

FIG. 11 illustrates another exemplary support member configuration. FIG. 11 is a bottom view of a portion of a ground engaging sole component 1100. Sole component 1100 may include a baseplate 1102 having a bottom surface 1105. Sole component 1100 may also include a ground engaging member 1110. As shown in FIG. 11, ground engaging member 1110 may have a substantially elongate cross-sectional shape.

Sole component 1100 may further include one or more elongate support members 1130. For example, as shown in FIG. 11, sole component 1100 may include a first elongate support member 1135, a second elongate support member 1140, and a third elongate support member 1145. As shown in FIG. 11, third elongate support member 1145, and at least one of first elongate support member 1135 and second elongate support member 1140 may be independent of any other ground engaging members extending from baseplate 1102.

As used in this detailed description and in the claims, the term "independent," shall refer to a lack of interaction and/or connection of an elongate support member with a ground engaging member other than the ground engaging member to which it abuts. Further, the term "independent" shall also refer to the lack of interaction and/or connection of an elongate support member with any other support members abutting another ground engaging member.

Ground engaging member 1110 may be elongated along a ground engaging member axis 1155. As shown in FIG. 11, first elongate support member 1135 and second elongate support member 1140 may each extend along an axis that is substantially aligned with ground engaging member axis 1155. In addition, third elongate support member 1145 may extend along a second support member axis 1160. As shown in FIG. 11, second support member axis 1160, and thus second elongate support member 1140, may be oriented in non-alignment with ground engaging member axis 1155. Further, in some embodiments, second elongate support member 1140 may be oriented substantially perpendicular to ground engaging member axis 1155. As shown in FIG. 11, second elongate support member 1140 may be disposed at a first angle 1165 with respect to ground engaging member axis 1155. In some embodiments, first angle 1165 may be approximately 90 degrees. First angle 1165 represents the angle between second elongate support member 1140 and third elongate support member 1145. In addition, a second angle 1170 represents the angle between first elongate support member 1135 and third elongate support member 1145. Thus, in embodiments where third elongate support member 1145 is disposed substantially perpendicular to ground engaging member axis 1155, second angle 1170 may be approximately 90 degrees.

Alternative embodiments, wherein an elongate support member extends in a direction that is in substantial non-alignment with an elongate ground engaging member, are depicted FIGS. 3A, 3B, and 7, which are discussed above. As shown in FIGS. 3A and 3B, sole component 300 may include an elongate support member 330 extending from ground engaging member 310. Support member 330 may abut ground engaging member 310 between dual projections 315 of ground engaging member 310. See also elongate support member 730 in FIG. 7, which may be oriented similarly with respect to dual projections 715 of ground engaging member 710.

Referring again to FIG. 11, first elongate support member 1140 and second elongate support member 1145 may be disposed on opposite sides of ground engaging member 1110, in substantial alignment with ground engaging member axis 1155. Therefore, first elongate support member 1140 and second elongate support member 1145 may be disposed in substantial alignment with each other. Accordingly, in such embodiments, third angle 1175 may be approximately 180 degrees.

Figure 12:
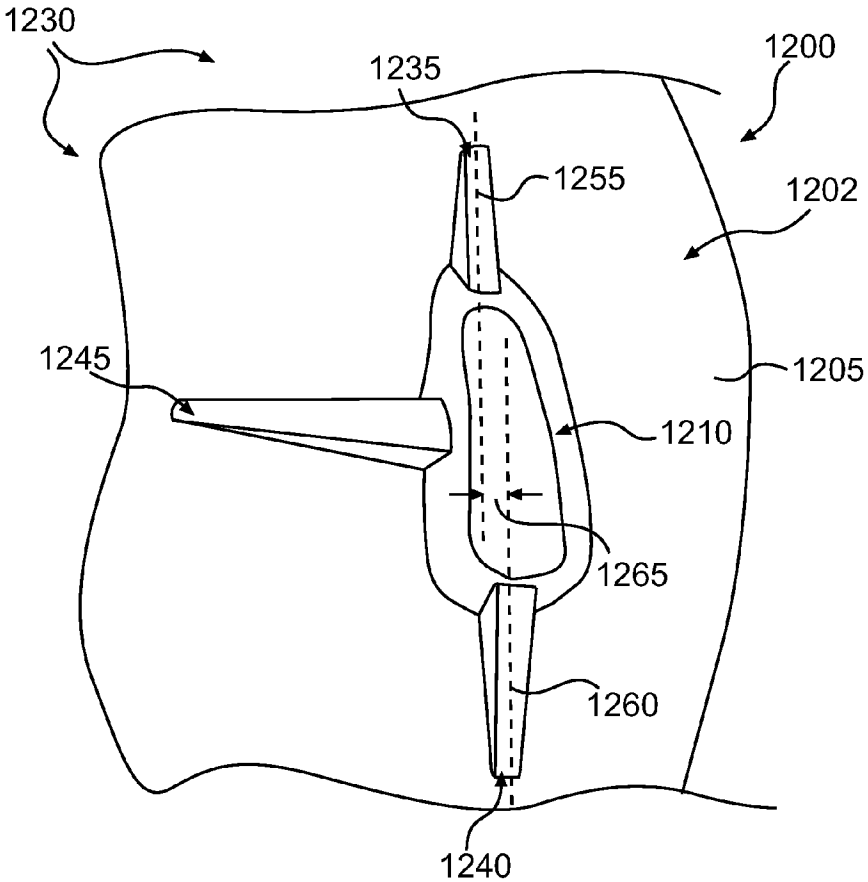
FIG. 12 is a schematic illustration of a bottom, partial perspective view of an exemplary tread configuration including a ground engaging member with elongate support members.

In some embodiments, support members on opposite sides of a ground engaging member may be substantially parallel to each other without being in alignment with each other. FIG. 12 is a bottom view of a portion of a ground engaging sole component 1200. Sole component 1200 may include a baseplate 1202 having a bottom surface 1205. Sole component 1200 may also include a ground engaging member 1210. As shown in FIG. 12, ground engaging member 1210 may have a substantially elongate cross-sectional shape.

Sole component 1200 may further include one or more elongate support members 1230. For example, as shown in FIG. 12, sole component 1200 may include a first elongate support member 1235, a second elongate support member 1240, and a third elongate support member 1245. First elongate support member 1235 and second elongate support member 1240 may be disposed substantially on opposite sides of ground engaging member 1210. First elongate support member 1235 may extend along a first axis 1255 and second elongate support member 1240 may extend along a second axis 1260. In some embodiments, first axis 1255 and second axis 1260 may be substantially parallel with one another but not aligned with one another, as shown in FIG. 12. For example, as shown in FIG. 12, first axis 1255 and second axis 1260 may be separated by a distance 1265. In some embodiments, third elongate support member 1245 may be omitted.

Spacing of Support Members

For many of the same reasons it may be desirable to have spacing between ground engaging members that is chosen to achieve certain performance parameters, it may also be desirable to select spacing between support members about a common ground engaging member. More closely spaced support members may provide significantly increased reinforcement of ground engaging members and may be suitable for providing traction on relatively hard surfaces. Conversely, more spaced apart support members may provide a less significant amount of reinforcement and may be more suitable for relatively softer surfaces. In addition, in some embodiments, the spacing about a ground engaging member may be substantially the same between all support members abutting that ground engaging member. In other embodiments, the spacing between such support members may be uneven.

In some embodiments, spacing between three or more support members abutting a common ground engaging member may be substantially the same between each support member. For example, referring again to FIG. 10, the spacing between elongate support members 1030 may be substantially the same. For example, as shown in FIG. 10, first elongate support member 1035 and second elongate support member 1040 may be separated by a first angle 1070. Second elongate support member 1040 and third elongate support member 1045 may be separated by a second angle 1075. In addition, third elongate support member 1045 and first elongate support member 1035 may be separated by a third angle 1080. As illustrated in FIG. 10, the spaces between elongate support members 1030 may be devoid of additional support members. Since the spacing between elongate support members 1030 may be substantially the same, in such embodiments, first angle 1070, second angle 1075, and third angle 1080 may each be approximately 120 degrees.

Referring again to FIG. 11, in some embodiments, three or more support members may be unevenly spaced about a common ground engaging member to which the support members abut. As shown in FIG. 11, elongate support members 1130 may be unevenly spaced about ground engaging member 1110. In some embodiments, first angle 1170 and second angle 1175 may be substantially different than third angle 1180, as discussed above. Also, as illustrated in FIG. 11, the spaces between elongate support members 1130 may be devoid of additional support members. In addition, each of elongate support members 1130 may be independent of other ground engaging members included on sole component 1100.

It should be noted that, although FIG. 10 depicts evenly spaced support members about a round ground engaging member and FIG. 11 depicts unevenly spaced support members about an elongate ground engaging member, spacing is not necessarily tied to the shape of the ground engaging member. Therefore, embodiments are envisaged wherein evenly spaced support members are disposed about an elongate ground engaging member, and likewise, embodiments are conceived wherein unevenly spaced support members are disposed about a round ground engaging member.

Sizing of Support Members

As discussed above, the sizing of a support member may have a significant effect on the amount of reinforcement, ground penetration and extraction, and traction provided by the support member. Accordingly, the sizing of each support member may be selected according to considerations discussed above in order to achieve desired performance characteristics.

In some cases variations in support member shape may influence the size of the support member. FIG. 6A illustrates how differences in shape may dictate changes in size. For example, as shown in FIG. 6A, each of support members 630 may have substantially the same height. That is, H1, H2, and H3 may be substantially the same. However, by varying the length of support members 630 about ground engaging member 910, support member 630 may be given a different shape. Since the height is the same across all three support members 630, changing the length of the support member results in a difference in overall size of the support member (and the amount of material used to form the support member). That is, in this case, the triangular surface area of vertical surfaces 640 respectively increases and decreases with increases and decreases in support member length. Therefore, not only do the changes in shape influence the reinforcement, ground penetration, and traction, but also the changes in shape can result in changes in support member size, which can also influence these characteristics. In other embodiments, the changes in shape may be substantially more complex, and so too can the resulting changes in size.

It should also be noted that even support members having substantially the same dimensions (e.g., length, width, and height), may have minor differences in overall size due to irregularities in the surfaces of the components to which the support members abut. For example, contours of the bottom surface of the baseplate, as well as the flaring of the ground engaging members near the junction between the ground engaging members and the baseplate may dictate small variations in the overall sizes of support members abutting these components. In addition, the angle at which a support member adjoins, for example, an elongate ground engaging member may influence the size of the support member. For example, if an elongate support member adjoins an elongate ground engaging member at a non-perpendicular angle, one side of the support member may be longer than the other. These subtle variations in shape and size may or may not have a significant effect on the resulting reinforcement, ground penetration and extraction, and traction provided by the support members.

As discussed above, in some embodiments, it may be advantageous, for various reasons, to have the configuration of each support member about a common ground engaging member to be substantially the same. In other embodiments, it may be beneficial for the configurations to differ. As discussed above, it may be advantageous to have the orientation of supporting members to be consistent or inconsistent about a common ground engaging member, depending on the desired performance characteristics. The orientation of support members may be selected independently of the size and shape of the support members, although all of these parameters may have collective effects on the reinforcement, ground penetration and extraction, and traction. Similarly, the sizing of support members may be selected independently of shape and orientation. For example, the sizing of support members about a common ground engaging member may be consistent, despite any inconsistency in the orientation of the support members. In some embodiments, the support members about a common ground member may be inconsistently oriented, for example, the support members may be unevenly spaced about the ground engaging member and/or some of the support members may be radially oriented and others may be non-radial. In such embodiments, the sizing (and/or shape) of the support members may be consistent.

FIG. 9 illustrates an exemplary embodiment, wherein support members 930 having the same size are disposed about ground engaging member 910.

Regarding the dimensions of support members 930, the heights of support members 930 may be substantially the same. For example, as shown in FIG. 9, first elongate support member 935 may have a first height 982, second elongate support member 940 may have a second height 984, and third elongate support member 945 may have a third height 986, wherein first height 982, second height 984, and third height 986 may be substantially the same.

As discussed above, it may be advantageous to have the orientations and spacing of supporting members to be consistent or inconsistent about a common ground engaging member in order to provide certain desired performance characteristics. The size and shape of support members may be selected independently of the orientation and/or spacing of the support members.

Referring again to FIG. 10, support members 1030 may have even spacing about ground engaging member 1010, and may also have consistent orientations, wherein each of support members 1030 may be oriented in a substantially radial direction. Nevertheless, even as the spacing and orientation of support members 1030 may be substantially consistent, and the shape of ground engaging member 1010 may be substantially regular (in this case round), the sizing of support members 1030 may be substantially uneven. As shown in FIG. 10, first elongate support member 1035 may have a first length 1082. In addition, second elongate support member 1040 may have a second length 1084, and third elongate support member 1045 may have a third length 1086. As shown in FIG. 10, first length 1082 of first elongate support member 1035 may be substantially the same as second length 1084 of second elongate support member 1040. However, as also shown in FIG. 9, third length 1086 may be substantially different (in this case longer) than first length 1082 and/or second length 1084.

With further regard to the size of support members, the thickness may be one of several significant factors that determine the performance characteristics of an elongate support member. In some embodiments, desired reinforcement, ground penetration and extraction, as well as traction may be provided by elongate support members having a width (thickness) in a horizontal direction that is smaller than the width of the ground engaging member to which it abuts. In some embodiments, the width of the support member may also be smaller than the width of an elongate ground engaging member to which it abuts.

Referring again to FIG. 11, one or more of support members 1130 may have a horizontal width that is narrower than ground engaging member 1110. As shown in FIG. 11, ground engaging member 1110 may be substantially elongate along ground engaging member axis 1155 oriented in a first horizontal direction. Ground engaging member 1110 may have a ground engaging member width 1180 in a second horizontal direction that is substantially perpendicular to the first horizontal direction. As shown in FIG. 11, first elongate support member 1135 may have a support member width 1182. As further shown in FIG. 11, support member width 1182 may be smaller than ground engaging member width 1180.

It is noted that, although a larger base width 1184 of ground engaging member 1110 is illustrated in FIG. 11 (and in other bottom views, such as FIGS. 9 and 10), base width 1184 corresponds with a flared aspect at the top of ground engaging member 1110. Consequently, the larger base width 1184 may be substantially limited to the uppermost portion of ground engaging member 1110, and thus, substantially the entire height of ground engaging member 1110 may have a thickness that approximates ground engaging member width 1180. Other configurations are also possible.

With further regard to the size of support members, the height of support members is one dimension that is a factor in the ultimate size of support members. In some embodiments the height of support members may be similar or the same as the height of the ground engaging member to which the support members are abutted (a configuration not shown in the accompanying figures). In other embodiments, the height of support members may be shorter than the height of the ground engaging member to which the support members are abutted. For example, in some embodiments, support members may extend downward from the bottom surface of the ground engaging sole component less distance than the first ground engaging member extends downward from the bottom surface of the ground engaging sole component. Such a configuration may facilitate ground penetration and/or ground extraction of the ground engaging members due to the periphery of the ground engaging members being unencumbered by additional elements at the tip portions of the ground engaging members. The difference in the heights of the support members and the ground engaging members may be selected in order to achieve desired performance, such as desired levels of reinforcement, ground penetration and extraction, and/or traction.

Figure 13:
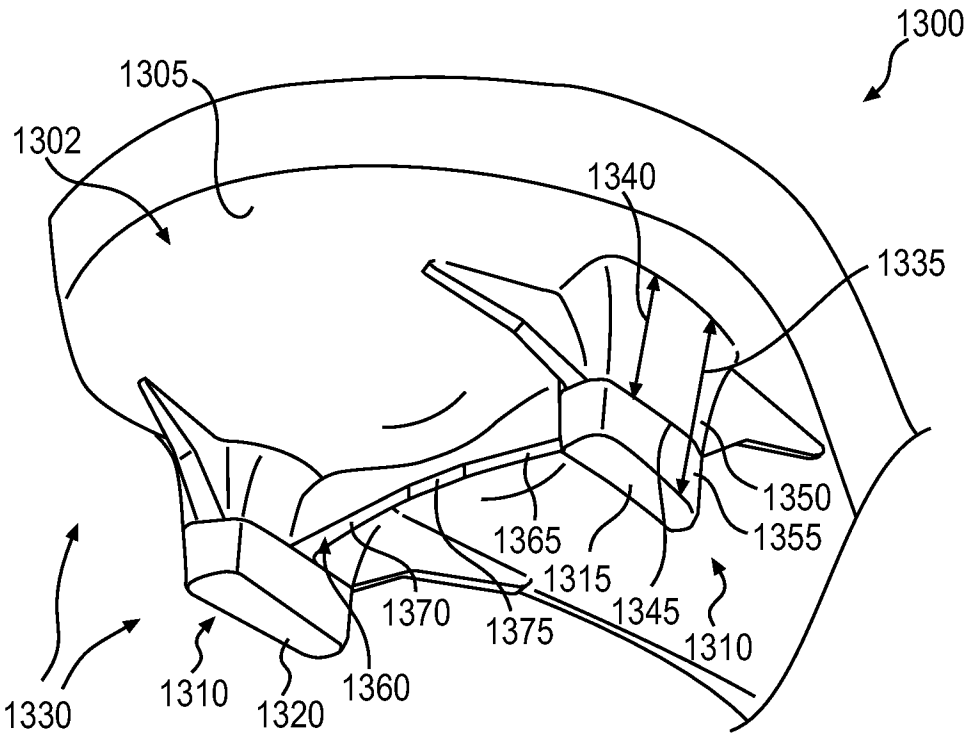
FIG. 13 is a schematic illustration of a bottom perspective view of an exemplary tread configuration including ground engaging members with elongate support members.

FIG. 13 is a bottom, perspective view of a heel region of an exemplary ground engaging sole component 1300. Sole component 1300 may include a baseplate 1302 having a bottom surface 1305. Sole component 1300 may also include one or more ground engaging members 1310. For example, sole component 1300 may include a first ground engaging member 1315 and a second ground engaging member 1320. Sole component 1300 may further include one or more elongate support members 1330.

As shown in FIG. 13, ground engaging members 1330 may have a ground engaging member height 1335. That is, ground engaging member 1330 may extend downward from bottom surface 1305 of baseplate 1302 a distance equivalent to ground engaging member height 1335. In addition support members 1330 may have a support member height 1340. That is, support members 1330 may extend downward from bottom surface 1305 of baseplate 1302 a distance equivalent to support member height 1340. In some embodiments, as shown in FIG. 13, support members 1330 may extend downward from bottom surface 1305 of baseplate 1302 less distance than ground engaging members 1310 extend downward from bottom surface 1305 of baseplate 1302. That is, support member height 1340 may be shorter than ground engaging member height 1335. In some embodiments, at least one of support members 1330 may extend more than half of the distance that ground engaging members 1310 extend downward from bottom surface 1305 of baseplate 1302, as shown in FIG. 13. In other embodiments, not shown, support members 1330 may extend half the distance or less than half the distance that ground engaging members 1310 extend from bottom surface 1305 of baseplate 1302.

Although the embodiments illustrated in the accompanying figures show support members about a common ground engaging member to have substantially the same heights, it is envisaged that certain embodiments may implement arrangements of support members wherein the heights of support members about a common ground engaging member are inconsistent.

Materials of Support Members

Suitable materials for forming ground engaging sole components are described above. As noted above, different components of the sole components may be formed of the same or different materials. In some embodiments, at least one of a plurality of support members abutting a common ground engaging member may be formed of the same material as at least a portion of the ground engaging member. This may facilitate the molding process of the ground engaging sole components. In other embodiments, the support members may be formed of a different material than the ground engaging member to which the support members are abutted. For example, it may be desirable to provide a support member that is substantially more rigid than the ground engaging member. With such a configuration, rigidity can be selectively provided to different aspects of the ground engaging member, in similar ways that the positioning, orientation, shape, and size of support members may selectively alter the performance characteristics of ground engaging members.

Further, in some embodiments, different portions of the same ground engaging member may be formed of different materials. For example, a ground engaging member may be formed of one material in portions where support members abut the ground engaging member, and may be formed of a different material in portions where support members do not abut the ground engaging member. In some embodiments, upper portions of ground engaging members, where support members are abutted, may be formed of a first material, whereas lower portions of ground engaging members, below the downward-most portions of support members, may be formed of a different material. The selection of these materials may be based on the performance characteristics of the materials in terms of providing strength, rigidity, ground penetration and extraction, and traction. In some embodiments the lower portions (e.g., tip portions) of ground engaging members may be formed of relatively softer materials (e.g., hard rubber) than upper portions of the ground engaging members. This may improve traction on various surfaces, and may also resist wear on non-playing surfaces (e.g., pavement) before and after participating in the activities for which the footwear is suited.

With further regard to FIG. 13, ground engaging members 1310 are illustrated as being divided vertically by a separator line 1345, which serves to delineate a ground engaging member upper portion 1350 and a ground engaging member lower portion 1355. In some embodiments, one or more of support members 1330 may be formed of the same material as at least a portion of ground engaging members 1310. For example, in some embodiments, support members 1330 may be molded simultaneously with upper portions 1350 of ground engaging members 1310, which are the portions of ground engaging members 1310 to which support members 1330 are abutted. In other embodiments, ground engaging members 1310 and support members 1330 may be formed of different materials.

Further, whether the two components are formed of the same material or not, the components may be joined after initial formation of one or both of the components. For example, in some embodiments, portions of sole component 1300, including baseplate 1302 and ground engaging members 1310, may be formed by a first molding process. Then, in an assembly process, support members 1310 may be welded to the preformed sole component 1300. Alternatively, in a second molding process, support members 1330 may be molded to the preformed portions of sole component 1300.

In some embodiments the tip portions of ground engaging members 1310 that extend below the downward-most portion of support members 1330 may be formed of a different material than the rest of ground engaging members 1310. For example, in some embodiments, lower portions 1355 of ground engaging members 1310 may be formed of a softer material than upper portions 1350 of ground engaging members 1310.

It is also noted that lower portions 1355 of ground engaging members 1310 may be replaceable. For example, lower portions 1355 may be removable cleat studs, which may be removably fastened to upper portions 1350 using any suitable fastening system, such as threads (such ground engaging members may sometimes be referred to as "screw-ins"). Such a configuration may enable a user to replace lower portions 1355, for example, when lower portions 1355 become worn, and/or in order to substitute a differently configured lower portion 1355. In some cases replacement lower portions 1355 may have different shapes, sizes, and/or may be formed of different materials.

Relationships with other Ground Engaging Members

Support members may provide improved reinforcement, ground penetration and extraction, and/or traction by virtue of the relationship between support members abutting one ground engaging member and the support members abutting a ground engaging member (and/or with the other ground engaging member itself) in the same arrangement. For example, in some cases, a common support member may be abutted to more than one ground engaging member. In some embodiments, for example, a support member may bridge between two ground engaging members to thereby form a braced, and thus reinforced, traction system. In some cases, the combination of the two ground engaging members and the bridging support member may provide strength, rigidity and/or traction in greater amounts than the individual components would separately.

As shown in FIG. 13, elongate support member 1330 may extend horizontally between first ground engaging member 1315 and second ground engaging member 1320 abutting both. Further, support member 1330 may have a downward facing surface 1365. In some embodiments, downward facing surface 1365 may include multiple facets. For example, as shown in FIG. 13, downward facing surface 1365 may include three facets. A first facet 1365 may be angled upward and away from first ground engaging member 1315 in the direction of second ground engaging member 1320. In addition, a second facet 1370 may be angled upward and away from second ground engaging member 1320 in the direction of first ground engaging member 1315. Further, a third facet 1375 may be disposed between first facet 1365 and second facet 1370. In addition, as shown in FIG. 13, third facet 1375 may be substantially horizontal.

In some embodiments, sole component 1300 may further includes second and third elongate support members 1380, 1382, extending substantially downward from bottom surface 1305 of baseplate 1302, abutting first ground engaging member 1315, and extending horizontally from first ground engaging member 1315. In addition, sole component 1300 may also include fourth and fifth elongate support members 1384, 1386 extending substantially downward from bottom surface 1305 of baseplate 1302, abutting second ground engaging member 1320, and extending horizontally from second ground engaging member 1320. As shown in FIG. 13, first, second, third, and fourth support members 1380, 1382, 1384, and 1386 may be arranged to form an H configuration.

Bridging support member configurations may be utilized at any suitable region of the foot. One exemplary location where the added rigidity of a bridging support member may be advantageous may include the heel region, as shown in FIG. 13. The heel region is often desired to be a relatively stiff area of an article of footwear. Further, as discussed above, the heel region is often raised to a certain extent and, therefore, ground engaging members in a heel region may be longer than in a forefoot region. Accordingly, it may be beneficial to reinforce longer ground engaging members in a heel region with a bridging support member.

Figure 14:
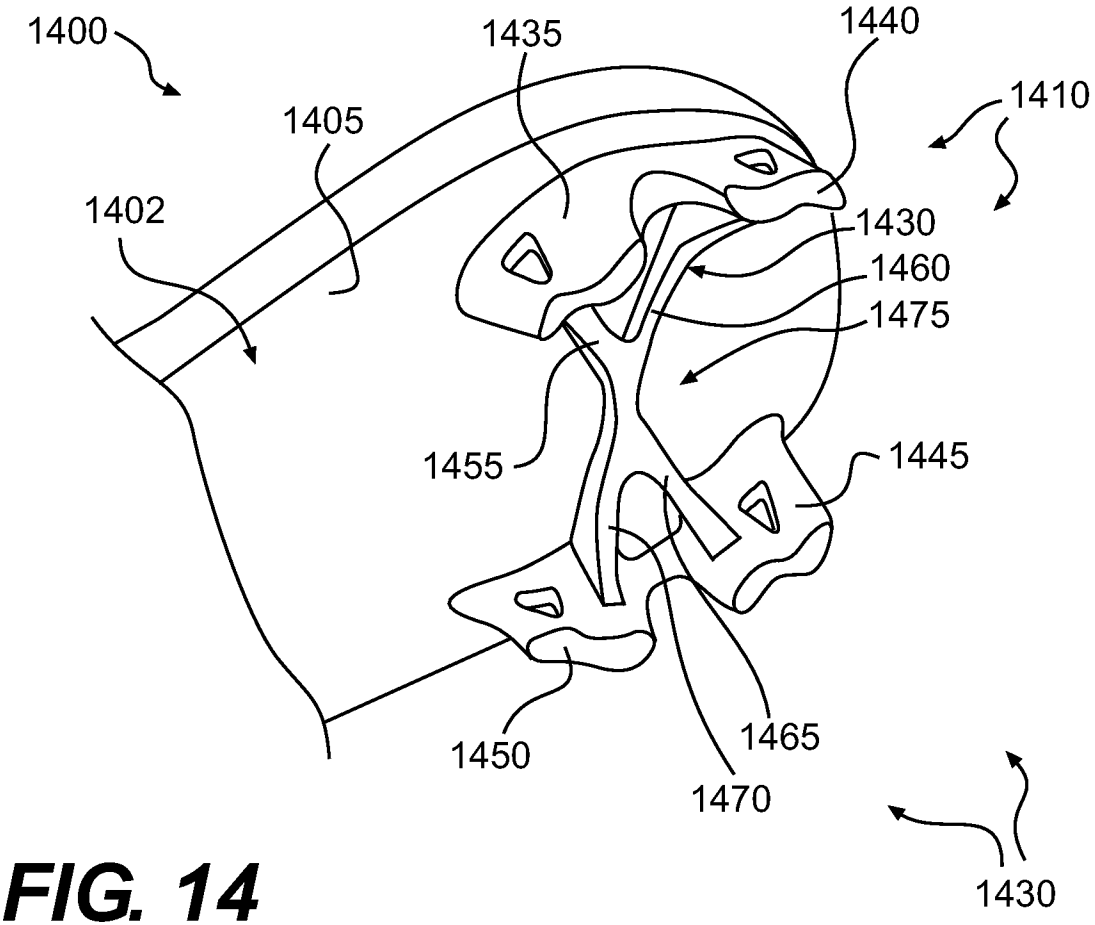
FIG. 14 is a schematic illustration of a bottom perspective view of an exemplary tread configuration including ground engaging members with elongate support members.

FIG. 14 is a bottom, perspective view of a heel region having an alternative bridging support member embodiment. As illustrated in FIG. 14, an exemplary ground engaging sole component 1400 may include a baseplate 1402 having a bottom surface 1405. Sole component 1400 may also include one or more ground engaging members 1410. Sole component 1400 may further include one or more elongate support members 1430.

In some embodiments, support members 1430 may be arranged to form an X configuration between ground engaging members 1410. Sole component 1400 may include a front left ground engaging member 1435, a rear left ground engaging member 1440, a rear right ground engaging member 1445, and a front right ground engaging member 1450. Each of these ground engaging members may have an elongate support member abutted to it and extending horizontally inward toward a lateral midline of sole component 1400. For example, a front left elongate support member 1455 may extend from front left ground engaging member 1435, a rear left elongate support member 1460 may extend from rear left ground engaging member 1440, a rear right elongate support member 1465 may extend from rear right ground engaging member 1445, and a front right elongate support member 1470 may extend from front right ground engaging member 1450. Support members 1430 may extend inward and intersect at a central portion 1475, thus forming an X configuration.

In some cases, it may be beneficial to dispose support members such that they are independent of any other ground engaging members. Further, it may be advantageous to orient support members such that the direction in which they extend from the ground engaging member to which they are abutted is not aligned with any other ground engaging members. By maintaining independence between different ground engaging members (and independence between the support members abutting one ground engaging member and the support members abutting other ground engaging members), spacing may be provided that may improve traction, for example, on relatively softer surfaces. Also keeping the components separate may prevent an excess of rigidity from being established by virtue of linking ground engaging members and the associated structures (for example, the support members), for example, in areas of the sole component where flexibility may be desired.

Figure 15:
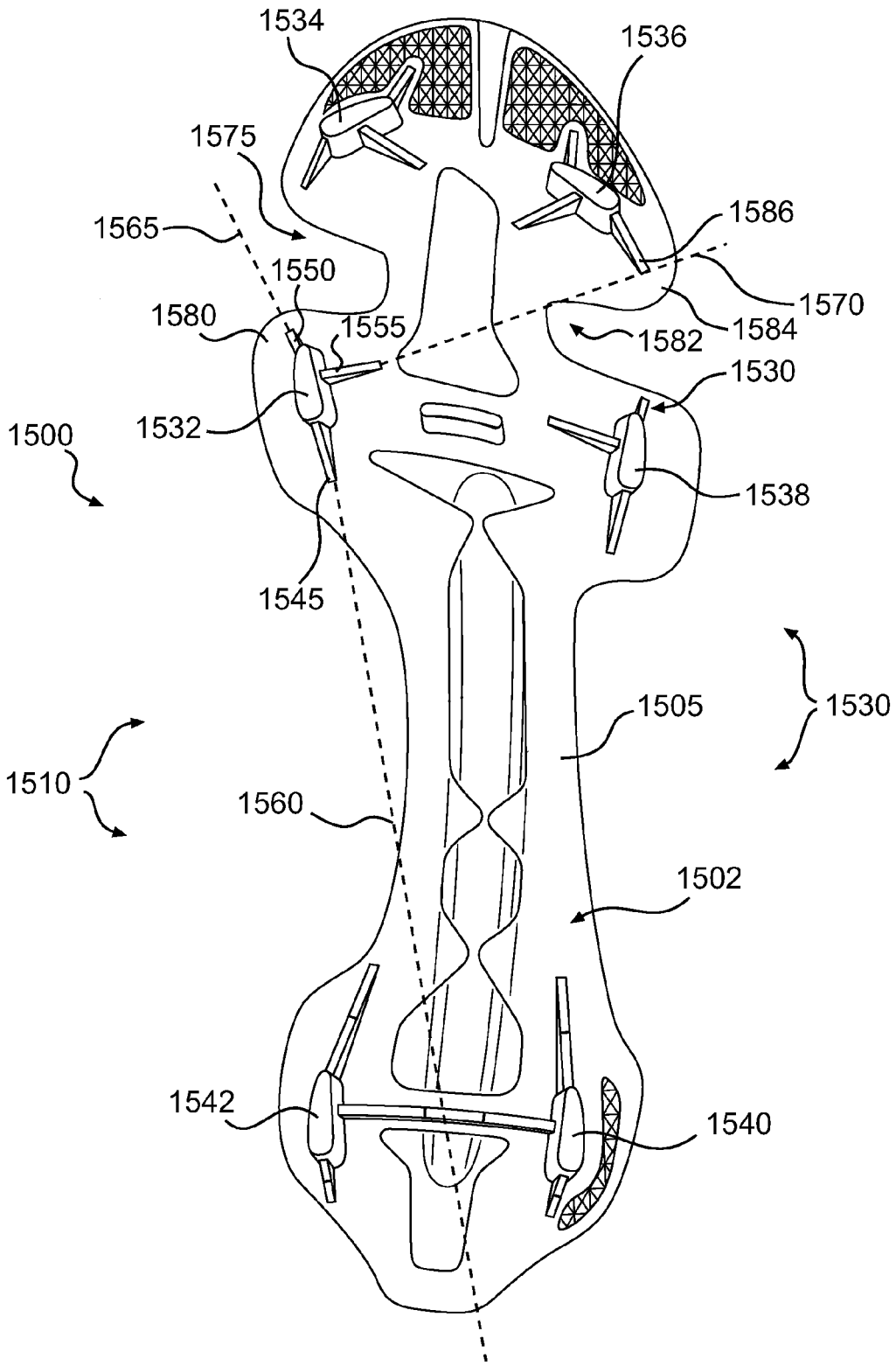
FIG. 15 is a schematic illustration of a bottom view of a ground engaging sole component having an exemplary tread configuration including ground engaging members with elongate support members.

FIG. 15 is a bottom view of an exemplary ground engaging sole component 1500. Sole component 1500 may include a baseplate 1502 having a bottom surface 1505, and one or more ground engaging members 1510 extending from bottom surface 1505 of baseplate 1502. Sole component 1500 may also include one or more elongate support members 1530. In some embodiments, sole component 1500 may include a first forefoot ground engaging member 1532, a second forefoot ground engaging member 1534, a third forefoot ground engaging member 1536, a fourth forefoot ground engaging member 1538, a first heel ground engaging member 1540, and a second heel ground engaging member 1542.

Support members 1530 may include, abutting first forefoot ground engaging member 1532, a first elongate support 1545, a second elongate support member 1550, and a third elongate support member 1555. As shown in FIG. 15, first elongate support 1545 may extend horizontally from first forefoot ground engaging member 1532 in a first direction indicated by a first axis 1560. Second elongate support member 1550 may extend horizontally from first forefoot ground engaging member 1532 in a second direction indicated by a second axis 1565. Third elongate support member 1555 may extend horizontally from first forefoot ground engaging member 1532 in a third direction indicated by a third axis 1570. In some embodiments, first axis 1560, second axis 1565, and/or third axis 1570 may be not aligned with any of ground engaging members 1510 on sole component 1500, as shown in FIG. 15. As further shown in FIG. 15, in some embodiments all of the support members (1530) abutted to the forefoot ground engaging members (1532, 1534, 1536, and 1538) may extend in directions that are not in alignment with any other forefoot ground engaging members 1532, 1534, 1536, and 1538. Axes are omitted from the other forefoot ground engaging members besides first forefoot ground engaging member 1532 for purposes of maintaining clarity of illustration. However, it will be understood, that as depicted in FIG. 15, the support members abutting second, third, and fourth forefoot ground engaging members 1534, 1536, and 1538 extend in substantial non-alignment with any of the other forefoot ground engaging members extending from baseplate 1502.

In some embodiments, the baseplate may have gaps or cutouts in the plate in order to allow different regions of the baseplate to flex in certain ways. It may be desirable, however, to maintain strength and rigidity in the baseplate portions that are adjacent to the gaps. In some embodiments, elongate support members may be oriented in such a manner that not only do the support members reinforce ground engaging members to which the support members are abutted, but they may also reinforce regions of the ground engaging sole component baseplate adjacent to a gap in the baseplate.

As shown in FIG. 15, sole component 1500 may have a first gap 1575 adjacent to a protruding portion 1580. In some embodiments, second elongate support member 1550, abutting first forefoot ground engaging member 1532, may extend into first protruding portion 1580 in order to provide reinforcement (strength and/or rigidity). In addition, sole component 1500 may also include a second gap 1582 adjacent to a second protruding portion 1584. Sole component 1500 may also include a fourth elongate support member 1586, abutting fourth forefoot ground engaging member 1536. As shown in FIG. 15, fourth elongate support member 1586 may extend into second protruding portion 1584 to provide reinforcement. Such baseplate reinforcement may be provided by elongate support members in any portions of the baseplate, including portions that are near gaps in the baseplate, as well as portions that are relatively distanced from gaps.

It may also be advantageous to implement elongate support members to provide reinforcement to portions of ground engaging members proximate to areas of ground engaging members from which material is absent. For example, it may be beneficial to form a ground engaging member, in some embodiments, with a hole in a central portion in order to reduce weight. In such embodiments, it may be desirable to provide the baseplate with an elongate support member abutting the ground engaging member in alignment with the hole. This may reinforce the ground engaging member in an area where the amount of material forming the ground engaging member has been reduced. While including such a support member may add weight back into the sole component, the weight may be added in a manner that provides reinforcement in a directional manner. In addition, by moving the material to a support member, the material may be used to also provide additional traction.

Referring again to FIGS. 4A and 4B, ground engaging member 410 may include hole 415 passing substantially horizontally through ground engaging member 410. In addition, as shown in FIGS. 4A and 4B, elongate support member 430 may include an aligned support member 455 abutting ground engaging member 410 in substantial alignment with hole 415.

In some embodiments, it may be advantageous to have one or more forefoot support members that extend in a relatively lateral orientation. This may provide desired longitudinal traction, and reinforcement of the baseplate in a central portion between lateral and medial ground engaging members. In some embodiments, it may be beneficial to extend the support members at slight angles relative to the lateral-medial direction. For example, in some embodiments generally laterally oriented support members in a forefoot region of the baseplate may extend at relatively shallow angles. Laterally oriented support members extending from first and second forward ground engaging members may intersect at a point forward of a line connecting first and second rearward ground engaging members. Alternatively or additionally, laterally oriented support members extending from first and second rearward ground engaging members may intersect at a point rearward of a line intersecting first and second forward ground engaging members.

Figure 16:
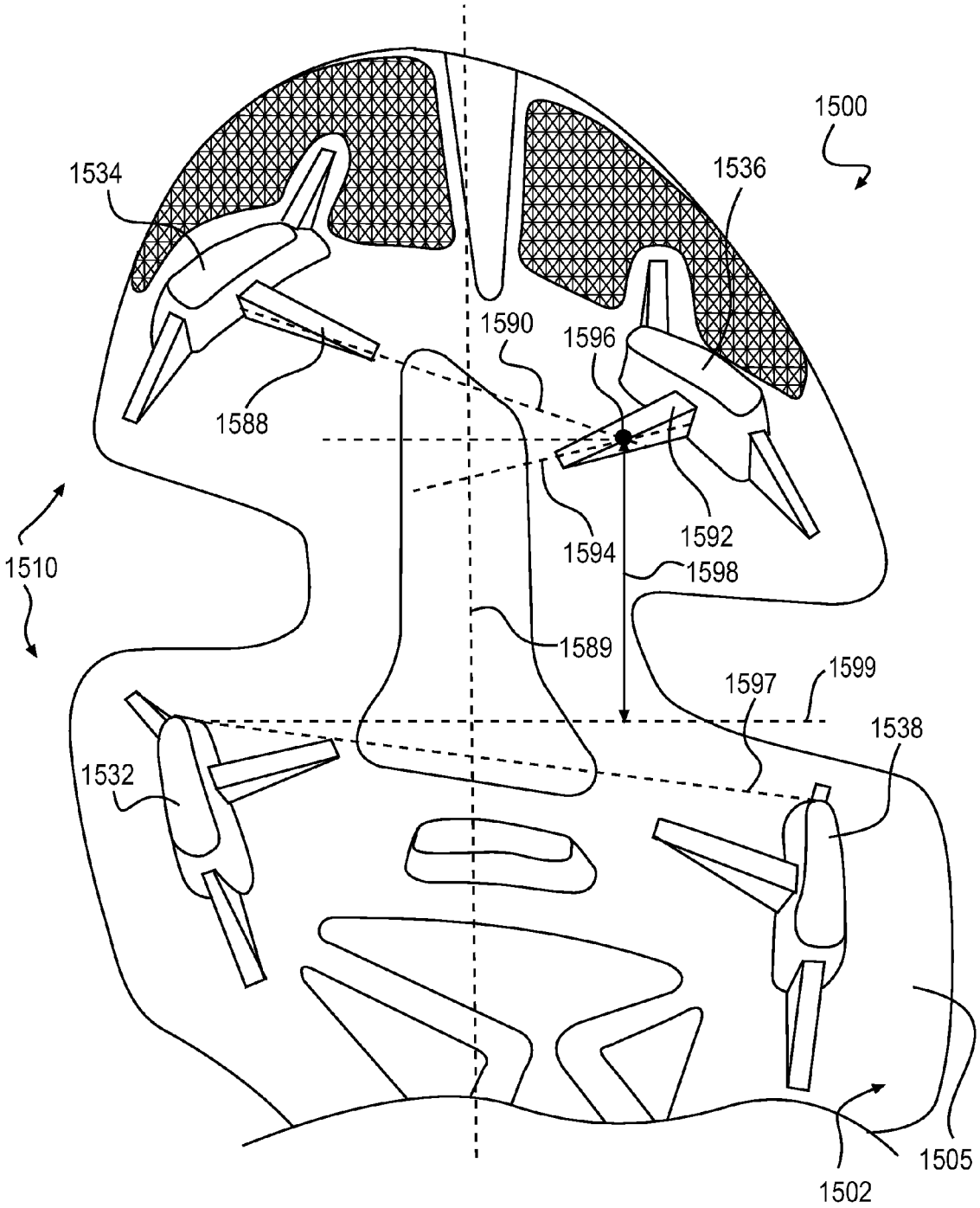
FIG. 16 is a schematic illustration of a bottom view of the forefoot region of the ground engaging sole component shown in FIG. 15.

FIG. 16 is a bottom view of the forefoot region of the ground engaging sole component configuration shown in FIG. 15. As shown in FIG. 16, second ground engaging member 1534 may include a first laterally oriented support member 1588 abutting second ground engaging member 1534 and extending laterally in a direction toward a lateral midline 1589 of baseplate 1502, wherein the direction is illustrated by a first lateral direction axis 1590. In addition, third ground engaging member 1536 may include a second laterally oriented support member 1592 abutting third ground engaging member 1536 and extending laterally in a direction toward lateral midline 1589 of baseplate 1502. First lateral direction axis 1590 and second lateral direction axis 1594 may intersect at an intersection point 1596. In some embodiments, intersection point 1596 may be forward of a line connecting first forefoot ground engaging member 1532 and fourth forefoot ground engaging member 1538. The distance between intersection point 1596 and the forward-most portion (indicated by line 1599) of the line 1597 connecting first forefoot ground engaging member 1532 and fourth forefoot ground engaging member 1538 is illustrated as longitudinal distance 1598.

Figure 17:
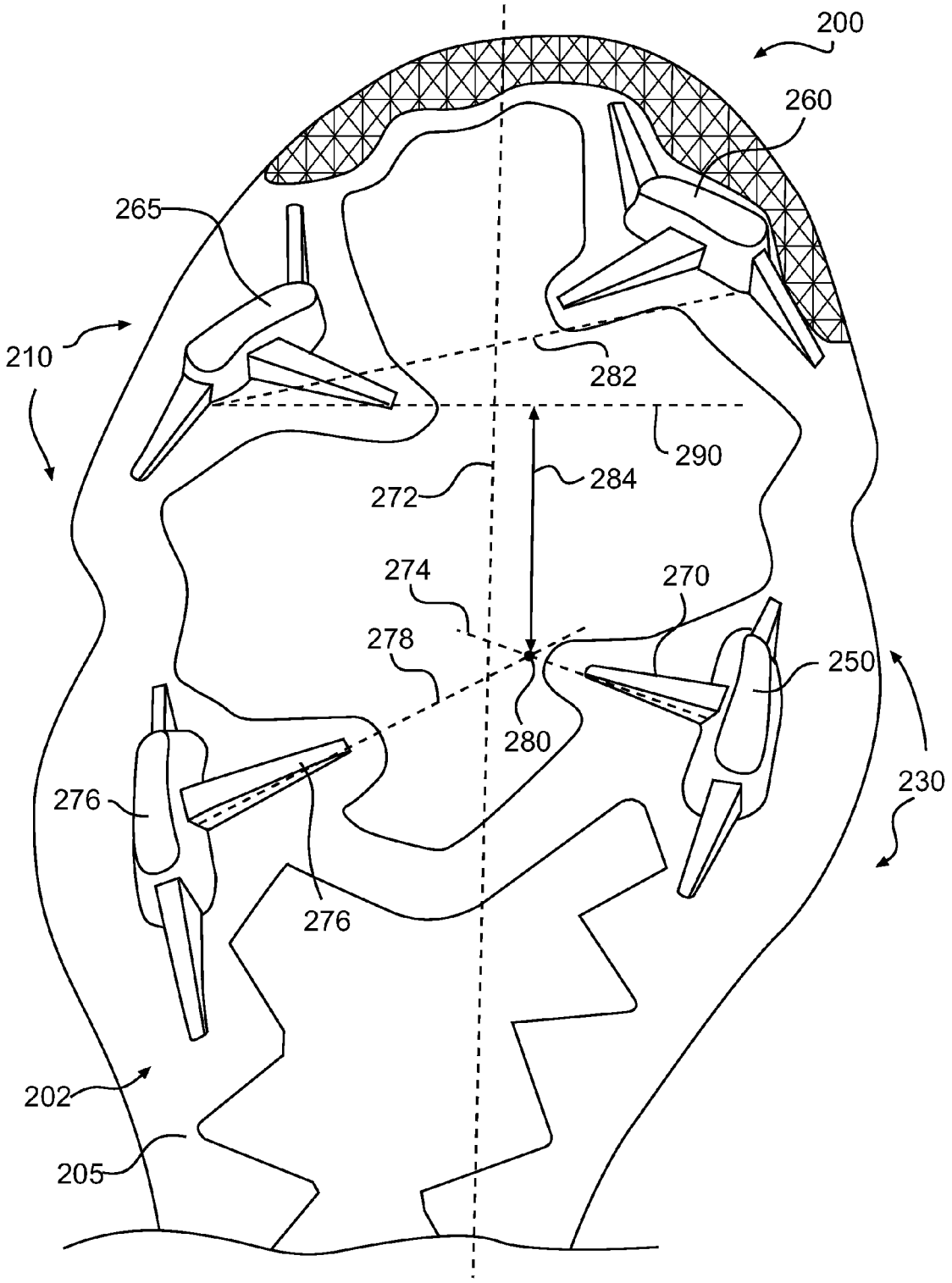
FIG. 17 is a schematic illustration of a bottom view of the forefoot region of the ground engaging sole component shown in FIG. 2.

FIG. 17 is a bottom view of the forefoot region of an exemplary ground engaging sole component. As shown in FIG. 17, sole component 200 may include a first rearward ground engaging member 250, a second rearward ground engaging member 255, a first forward ground engaging member 260, and a second forward ground engaging member 265. In addition, sole component 200 may also include a first laterally oriented support member 270 abutting first rearward ground engaging member 250 and extending laterally in a direction toward a lateral midline 272 of baseplate 202, wherein the direction is illustrated by a first lateral direction axis 274. In addition, sole component 200 may include a second laterally oriented support member 276 abutting second rearward ground engaging member 255 and extending laterally in a direction toward lateral midline 272 of baseplate 202, wherein the direction is illustrated by a second lateral direction axis 278. First lateral direction axis 274 and second lateral direction axis 278 may intersect at an intersection point 280. In some embodiments, intersection point 280 may be rearward of a line 282 connecting first forward ground engaging member 260 and second forward ground engaging member 265. The distance between intersection point 280 and the rearward-most portion (indicated by line 290) of line 282 connecting first forward ground engaging member 260 and second forward ground engaging member 265 is illustrated as longitudinal distance 284.

For purposes of explanation, the orientation of support members extending from forward ground engaging members is discussed in conjunction with FIG. 16, and the orientation of support members extending from rearward ground engaging members is discussed separately in conjunction with FIG. 17. However, it should be noted that, in the embodiment shown in FIG. 16, the rearward support members may be oriented as shown in FIG. 17, and are depicted as such in FIG. 16. The dimensioning illustrating this feature has been omitted from FIG. 16 in order to maintain the clarity of the drawing. Similarly, in the embodiment shown in FIG. 17, the forward support members may be oriented as shown in FIG. 16, and are depicted as such in FIG. 17. Again, the dimensioning illustrating this feature has been omitted from FIG. 17 in order to maintain the clarity of the drawing.

In some embodiments, it may be advantageous to include one or more secondary traction features at various portions of the sole component. In some embodiments, it may be beneficial to provide such secondary traction features proximate to one or more ground engaging members. In some cases, secondary traction features, such as a textured traction surface may be disposed between elongate support elements abutting and extending from a ground engaging member.

Figure 18:
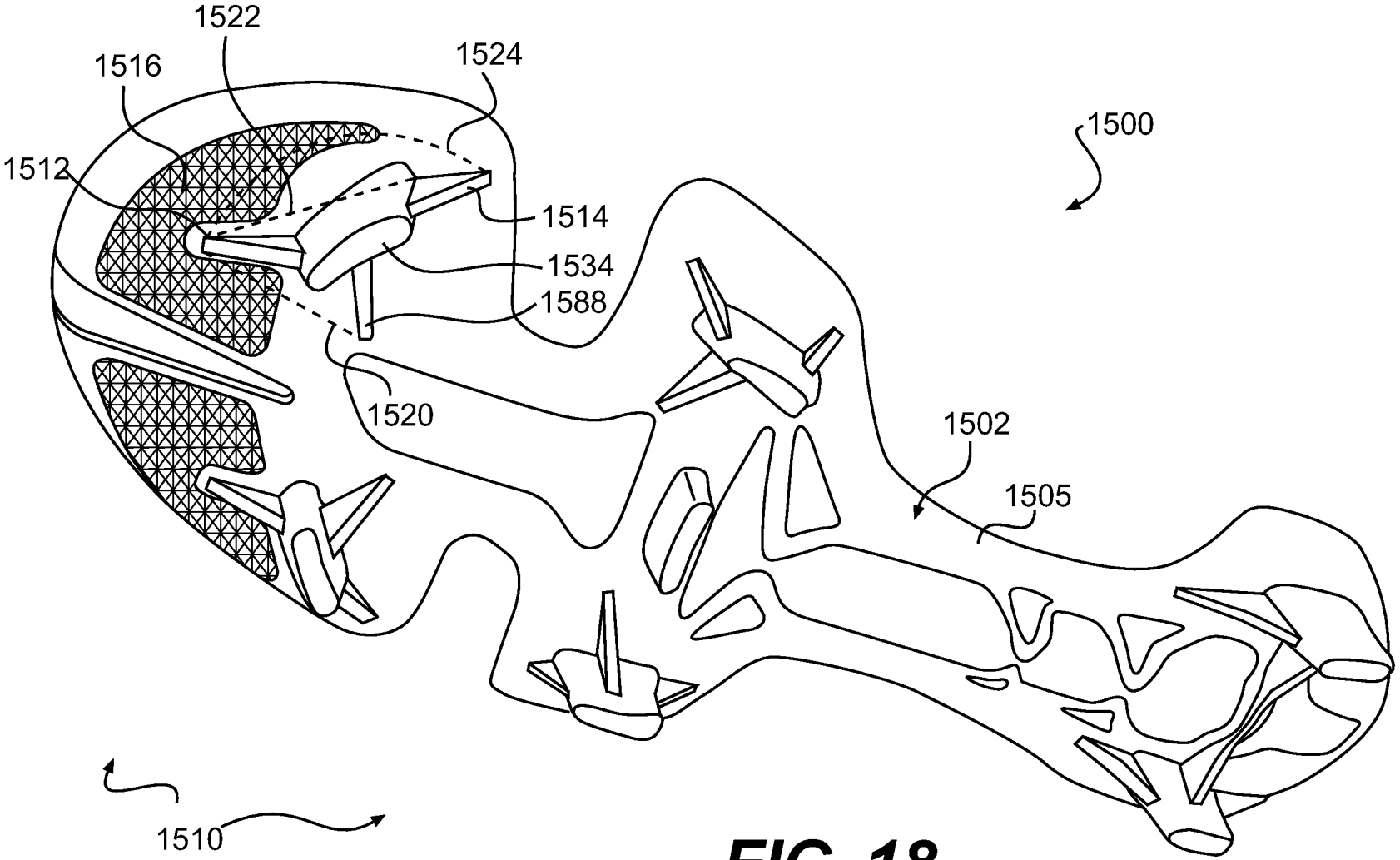
FIG. 18 is a schematic illustration of a bottom perspective view of the ground engaging sole component shown in FIG. 15.

FIG. 18 is a perspective bottom view of the sole component embodiment shown in FIGS. 15 and 16. As shown in FIG. 18, sole component 1500 may include first laterally oriented support member 1588, a forward-oriented elongate support member 1512, and an additional elongate support member 1514 abutting and extend from second forefoot ground engaging member 1534. In some embodiments, as shown in FIG. 18, sole component 1500 may include a textured element 1516, which may be disposed, at least in part, between support members 1588 and 1512, and/or between support members 1512 and 1514.

Textured element 1516 may include textured traction surface including a plurality of peaked ground engaging members 1518. (See FIG. 1.) Peaked ground engaging members 1518 may have a height that is substantially less than ground engaging members 1510. In some embodiments, peaked ground engaging members 1518 may have a height in the range of about 1.0-5.0 mm. In some cases, the height of peaked ground engaging members 1518 may be in the range of about 1.5-2.5 mm, for example approximately 2.0 mm.

For purposes of this disclosure, the term "between," as used in the context of the placement of textured elements between support members, refers to being either "linearly between" or "rotationally between" support members, as explained in the following paragraphs.

In some embodiments, textured element 1516 may be disposed, at least in part, linearly between support members. As illustrated in FIG. 18, a linear boundary between support members 1588 and 1512 is illustrated by line 1520. As illustrated in FIG. 18, at least a portion of textured element 1516 may be disposed within the linear boundary delineated by line 1520. Thus, at least a portion of textured element 1518 may be disposed linearly between support members 1588 and 1512. That is, at least one line can be drawn between support members 1588 and 1512 that crosses textured element 1518.

In some embodiments, textured element 1516 may be disposed rotationally between support members. In some cases, a textured element may be disposed rotationally between support members but may not be linearly between the support members. As shown in FIG. 18, a linear boundary between support members 1512 and 1514 is illustrated as line 1522. As further shown in FIG. 18, in some embodiments, no portion of textured element 1518 may fall within the boundary delineated by line 1522. However, a rotational boundary between support members 1512 and 1514 may be indicated by rotational line 1524. As indicated in FIG. 18, at least a portion of textured element 1518 may be disposed within the rotational boundary delineated by rotational line 1524. Thus, at least a portion of textured element 1518 may be disposed rotationally between support members 1512 and 1514.

Figure 19:
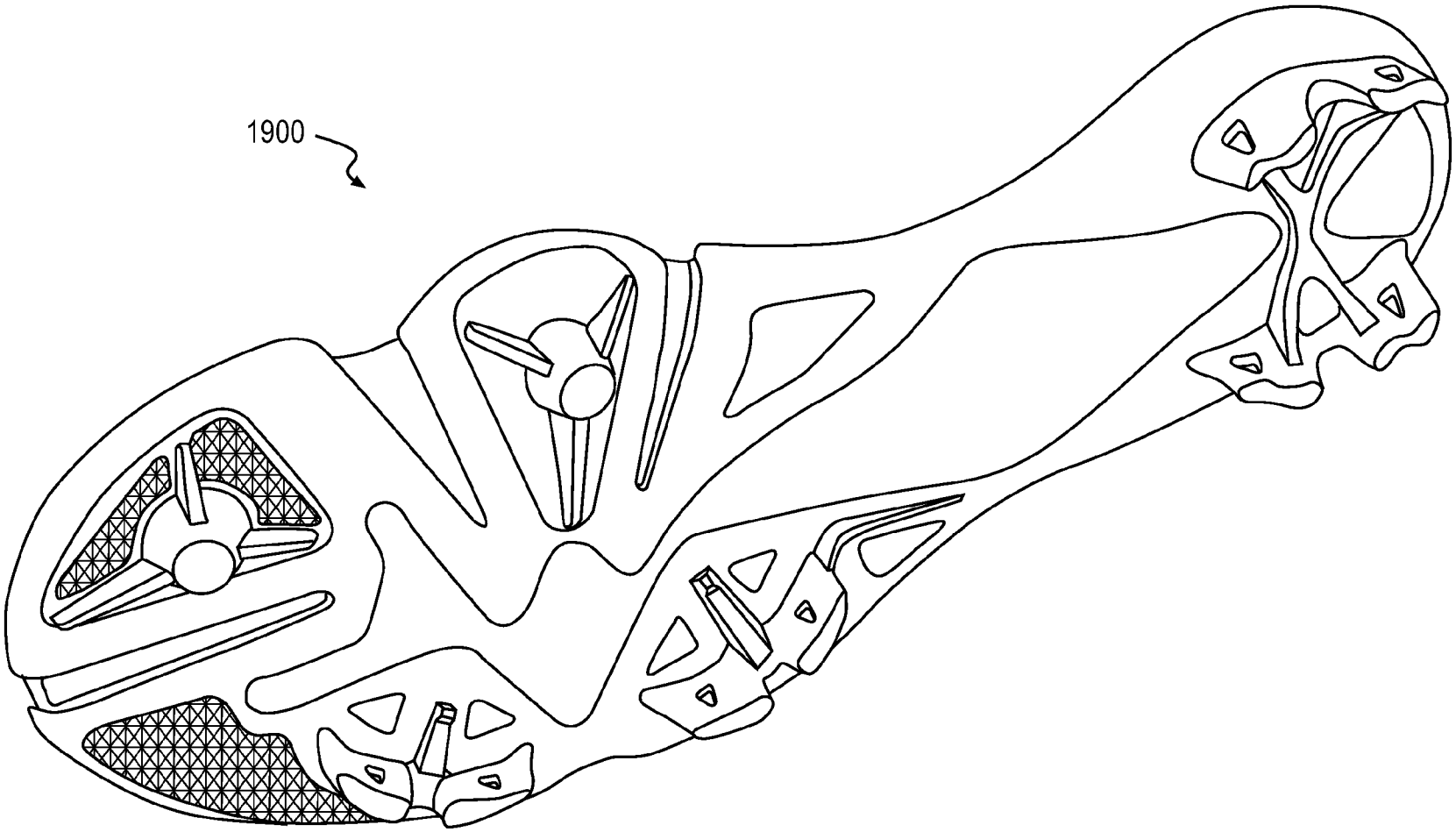
FIG. 19 is a schematic illustration of a bottom perspective view of an exemplary ground engaging sole component having an exemplary tread configuration including ground engaging members with elongate support members.

FIG. 19 illustrates an exemplary ground engaging sole component 1900. Several aspects of FIG. 19 are shown in other figures, for example, FIGS. 5, 7, 10, and 14. In addition, various features of sole component 1900 are discussed above in conjunction with other embodiments.

Figure 20:
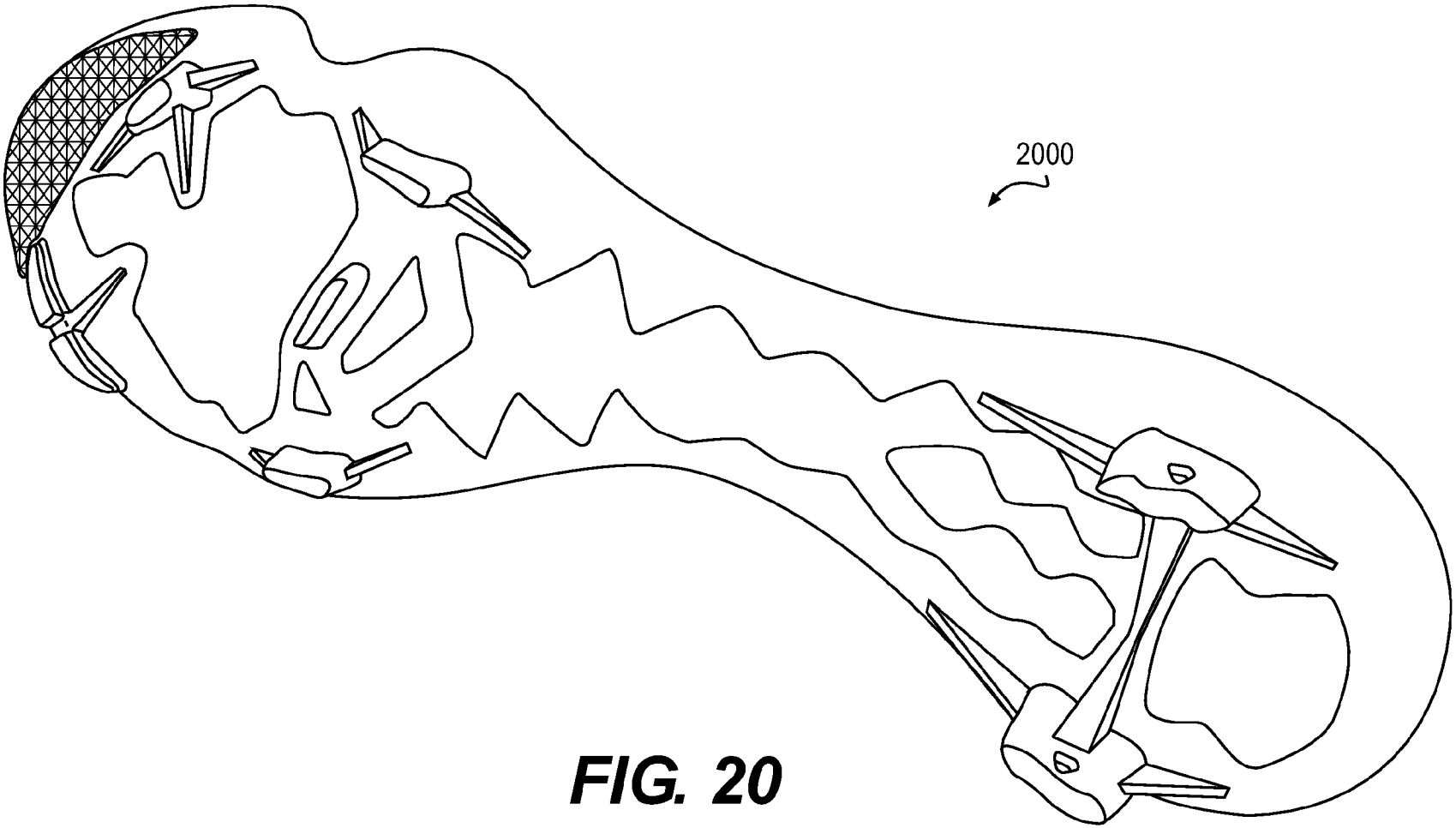
FIG. 20 is a schematic illustration of a bottom perspective view of an exemplary ground engaging sole component having an exemplary tread configuration including ground engaging members with elongate support members.

FIG. 20 illustrates an exemplary ground engaging sole component 2000. Several aspects of FIG. 20 are shown in other figures, for example, FIGS. 3A, 3B, 4A, and 4B. In addition, many of the features of sole component 2000 are discussed above in conjunction with other embodiments.

Although many possible combinations of features are shown in the accompanying figures and discussed in this detailed description, many other combinations of the disclosed features are possible. Therefore, it will be understood that any of the features shown and/or discussed in the present disclosure may be implemented together in any suitable combination.

Observable Functionality

The shapes and orientations of support members disclosed herein, may be non-symmetrical, and/or irregular, and thus, may be indicative to observers (for example, potential users) that the shapes and orientations are purposeful for more than mere aesthetics. The shape, placement, orientation, and/or size of support members may indicate to users that the sole structure has certain performance characteristics. For example, placement of a support member abutting a ground engaging member may indicate that the ground engaging member is reinforced. Further, the orientation of the support member may indicate the direction in which the ground engaging member has been reinforced.

In some cases, an athlete who has experienced a broken cleat stud may be shopping for a shoe with stronger cleat studs. The athlete may, when shopping for new shoes, find a shoe with a sole structure having a cleat stud with one or more abutting support members and assess that the cleat stud with abutting support members may be reinforced. While the quantitative degree to which the cleat stud is reinforced may not be evident from mere visual observation, the visually-observable qualitative characteristic of the cleat stud being reinforced may provide a basis upon which an athlete may select a particular shoe.

In addition, the location and orientation of the support member may indicate that additional traction is provided in a direction generally perpendicular to the support member. Accordingly, a potential user looking for a shoe having ground engaging members with improved traction in a particular location and/or direction may observe attributes of a sole structure that provide the desired characteristics. For example, an athlete may find that lateral traction is less than desired in the region of his current shoes that corresponds with a distal portion of the first phalanx. The athlete may, when shopping for a new shoe, observe that an available shoe has a cleat stud in this region that includes, abutting the cleat stud, one or more support members that are oriented longitudinally. Accordingly, the athlete may be able to assess that additional lateral traction may be provided by the support members. While the quantitative amount of traction provided by the support members may not be readily observed visually, the visually-observable qualitative characteristic of directional traction (specifically lateral in this case) may provide a basis upon which an athlete may select a particular shoe.

Selection of shoes is discussed above as being associated with a shoe purchase. However, the factors considered above in conjunction with a purchase may also apply to choosing a shoe from an owner's collection to use for a particular event. For example, a user may find that additional lateral heel traction is beneficial when playing on soft, wet turf. Accordingly, when choosing a shoe for an event that is to be played on soft, wet turf, the athlete may select, from his own shoe collection, a shoe having longitudinally oriented support members abutting heel cleat studs.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

an upper configured to receive a foot; and a sole component fixedly attached to a bottom portion of the upper, the sole component including a baseplate having a bottom surface and at least a first ground engaging member having a first sidewall and a second opposite sidewall both extending substantially vertically downward in a first direction from the bottom surface of the baseplate and having a hole passing all of the way through the first ground engaging member from the first sidewall to the second sidewall, and a first support member extending substantially downward, in the first direction, from the bottom surface of the baseplate;

wherein the first support member has a height extending in the first direction, a width, and a length that is longer than the width;

wherein the first support member includes a downward facing surface extending at an angle between the first ground engaging member and the bottom surface of the baseplate;

wherein the first support member abuts the first sidewall of the first ground engaging member in alignment with the hole, and the entire length of the first support member extends horizontally from the first sidewall of the first ground engaging member; and wherein the downward facing surface of the first support member intersects with the first sidewall of the first ground engaging member at a position that is between the hole and the bottom surface of the baseplate.

2. The article of footwear according to claim 1, wherein the first support member extends substantially radially from an approximate center portion of the first ground engaging member.

3. The article of footwear according to claim 2, the first ground engaging member has a height extending in the first direction, a width, a length that is longer than the width, and a longitudinal axis extending through a centerline of the first ground engaging member along the length of the first ground engaging member and the width of the first ground engaging member tapers from the bottom surface of the baseplate toward a ground side surface of the ground engaging member.

4. The article of footwear according to claim 1, wherein the sole component includes multiple support members extending substantially downward in the first direction from the bottom surface of the baseplate, each of the multiple support members having a height extending in the first direction, a width, a length that is longer than the width and wherein each of the multiple support members abuts the first ground engaging member and extends radially from the first ground engaging member, wherein the lengths of the multiple support members are substantially different from one another.

5. The article of footwear according to claim 1, wherein the first ground engaging member has a height extending in the first direction, a width, a length that is longer than the width, and a longitudinal axis extending through a centerline of the first ground engaging member along the length of the first ground engaging member wherein the first support member has a longitudinal axis extending through a centerline of the first support member along the length of the first support member, and wherein the width of the first support member is smaller than the width of the ground engaging member.

6. The article of footwear according to claim 5, wherein the height of the first support member is less than the height of the first ground engaging member.

7. The article of footwear according to claim 1, wherein the first ground engaging member has a height extending in the first direction, a width, a length that is longer than the width, and a longitudinal axis extending through a centerline of the first ground engaging member along the length of the first ground engaging member and the first support member has a longitudinal axis extending through a centerline of the first support member along the length of the first support member.

8. The article of footwear according to claim 7, wherein the width of the first support member tapers with distance away from the first ground engaging member.

9. The article of footwear according to claim 1, wherein the sole component further includes a second ground engaging member;

wherein the second ground engaging member has a third sidewall extending substantially downward in the first direction from the bottom surface of the baseplate;

wherein the first support member extends substantially downward in the first direction from the bottom surface of the baseplate, the first support member having a height extending in the first direction, a width, a length that is longer than the width, and a longitudinal axis extending through a centerline of the first support member along the length of the first support member; and wherein the first support member is extending between and abutting the first sidewall of the first ground engaging member and the third sidewall of the second ground engaging member.

10. The article of footwear according to claim 9, wherein the sole component further includes second, third, fourth, and fifth support members extending substantially downward in the first direction from the bottom surface of the baseplate;

wherein the second support member abuts the first ground engaging member and has a height extending in the first direction, a width, a length that is longer than the width, and a longitudinal axis extending through a centerline of the second support member along the length of the second support member;

wherein the third support member abuts the first ground engaging member and has a height extending in the first direction, a width, a length that is longer than the width, and a longitudinal axis extending through a centerline of the third support member along the length of the third support member;

wherein the fourth support member abuts the second ground engaging member and has a height extending in the first direction, a width, a length that is longer than the width, and a longitudinal axis extending through a centerline of the fourth support member along the length of the fourth support member;

wherein the fifth support member abuts the second ground engaging member and has a height extending in the first direction, a width, a length that is longer than the width, and a longitudinal axis extending through a centerline of the fifth support member along the length of the fifth support member; and wherein the first, second, third, fourth, and fifth support members are arranged to form an H configuration.

11. The article of footwear according to claim 9, wherein the width of the first support member tapers toward a midpoint between the first ground engaging member and the second ground engaging member.

12. The article of footwear according to claim 11, wherein the first support member tapers from a first width at the first ground engaging member and the second ground engaging member to a second, narrower width, at the midpoint between the first ground engaging member and the second ground engaging member.

13. The article of footwear according to claim 9, wherein the second ground engaging member has a third sidewall and a fourth sidewall opposite the third sidewall and a second hole passing all of the way through the second ground engaging member from the third sidewall to the fourth sidewall.

14. The article of footwear according to claim 9, wherein the first ground engaging member has a tilde-shaped horizontal cross-sectional shape.

15. The article of footwear according to claim 9, wherein the first ground engaging member has a third sidewall and a fourth sidewall and wherein the sole component further includes a second support member and a third support member;

wherein the second support member extends substantially downward in the first direction from the bottom surface of the baseplate, the second support member having a height extending in the first direction, a width, a length that is longer than the width, and a longitudinal axis extending through a centerline of the second support member along the length of the second support member and wherein the second support member is extending from and abutting the third sidewall of the first ground engaging member; and wherein the third support member extends substantially downward in the first direction from the bottom surface of the baseplate, the third support member having a height extending in the first direction, a width, a length that is longer than the width, and a longitudinal axis extending through a centerline of the third support member along the length of the third support member and wherein the third support member is extending from and abutting the fourth sidewall of the first ground engaging member.

16. The article of footwear according to claim 15, wherein the length of the second support member is longer than the length of the third support member.

17. The article of footwear according to claim 9, wherein the height of the first support member is less than the height of the first ground engaging member.

18. The article of footwear according to claim 1, wherein the first ground engaging member and the first support member are comolded.

19. The article of footwear according to claim 9, wherein the width of the first ground engaging member is substantially the same as a width of the first hole.

20. The article of footwear according to claim 9, wherein the first support member abuts the third sidewall of the second ground engaging member in alignment with a second hole passing through the second ground engaging member.

* * * * *